US010350729B2

(12) United States Patent
Coulson

(10) Patent No.: US 10,350,729 B2
(45) Date of Patent: Jul. 16, 2019

(54) ICE BLASTING SYSTEM AND METHOD

(71) Applicant: Coulson Ice Blast Ltd., Port Alberni (CA)

(72) Inventor: Foster Coulson, Port Alberni (CA)

(73) Assignee: Coulson Ice Blast Ltd., Port Alberni, British Columbia ( * ) Notice: Subject to any disclaimer, the term of this patent is extended or adjusted under 35 U.S.C. 154(b) by 0 days.

(21) Appl. No.: 15/544,415

(22) PCT Filed: Jan. 27, 2017

(86) PCT No.: PCT/CA2017/050093

§ 371 (c)(1),
(2) Date: Jul. 18, 2017

(87) PCT Pub. No.: WO2017/127935

PCT Pub. Date: Aug. 3, 2017

(65) Prior Publication Data

US 2018/0318982 A1 Nov. 8, 2018

Related U.S. Application Data

(60) Provisional application No. 62/287,742, filed on Jan. 27, 2016, provisional application No. 62/292,999, (Continued)

(51) Int. Cl.
*B24C 1/00* (2006.01)
*B24C 3/06* (2006.01)
(Continued)

(52) U.S. Cl.
CPC ..... *B24C 1/003* (2013.01); *B08B 3/026* (2013.01); *B24C 3/06* (2013.01); *B24C 7/0015* (2013.01)

(58) Field of Classification Search
CPC ..... B08B 3/026; B24C 1/003; B24C 3/06; B24C 3/062; B24C 5/02; B24C 5/04; (Continued)

(56) References Cited

U.S. PATENT DOCUMENTS 4,707,951 A 11/1987 Gibot et al.
6,174,225 B1 * 1/2001 Becker ..... B24C 1/003 451/39
(Continued)

FOREIGN PATENT DOCUMENTS

CA 2121269 10/1994
DE 19920296 A1 11/2000
(Continued)

OTHER PUBLICATIONS

"International Application No. PCT/CA2017/050093, International Search Report and Written Opinion dated Mar. 21, 2017", (dated Mar. 21, 2017), 11 pgs.
(Continued)

*Primary Examiner* — Timothy V Eley
(74) *Attorney, Agent, or Firm* — Schwegman Lundberg & Woessner, P.A.

(57) ABSTRACT

A blast cleaning system has a nozzle configured to deliver a pressurized blast cleaning media. The blast cleaning media includes a pressurized fluid and water ice particles as the primary blast cleaning component. The system includes an input hopper configured to accept supplied water ice in bulk form from an outside source. The system further includes a particle sizing module configured to produce the water ice particles for the pressurized blast cleaning media from the supplied water ice after the supplied water ice has been accepted into the input hopper.

17 Claims, 24 Drawing Sheets

Related U.S. Application Data filed on Feb. 9, 2016, provisional application No. 62/294,161, filed on Feb. 11, 2016, provisional application No. 62/294,710, filed on Feb. 12, 2016.

(51) Int. Cl.
*B24C 7/00* (2006.01)
*B08B 3/02* (2006.01)

(58) Field of Classification Search
CPC ... B24C 7/0015; B24C 7/0053; B24C 7/0084; B24C 7/0092
See application file for complete search history.

(56) References Cited

U.S. PATENT DOCUMENTS

| | | | | |
|---|---|---|---|---|
| 6,270,394 | B1 | 8/2001 | Visaisouk et al. | |
| 6,890,246 | B2 * | 5/2005 | Yamaharu | B24C 1/003 451/75 |
| 7,112,120 | B2 * | 9/2006 | Rivir | B24C 1/003 222/170 |
| 8,430,722 | B2 * | 4/2013 | Raeder | B24C 1/003 241/227 |
| 9,592,586 | B2 * | 3/2017 | Lehnig | B24C 1/003 |
| 9,649,745 | B2 * | 5/2017 | Demirtas | B24C 1/003 |
| 9,700,989 | B1 * | 7/2017 | Cooper | B24C 1/00 |
| 2004/0005848 | A1 | 1/2004 | Yamaharu | |
| 2006/0178092 | A1 | 8/2006 | Spivak et al. | |
| 2006/0205326 | A1 * | 9/2006 | Dressman | B24C 1/003 451/38 |
| 2010/0113576 | A1 | 5/2010 | Raeder et al. | |

FOREIGN PATENT DOCUMENTS

| | | | |
|---|---|---|---|
| DE | 202010000713 | | 5/2010 |
| DE | 202013100381 | | 2/2013 |
| DE | 102013002635 | | 8/2014 |
| EP | 0316264 | | 5/1989 |
| EP | 1852221 | A1 | 11/2007 |
| JP | 2008068341 | A | 3/2008 |
| JP | 2012161884 | A | 8/2012 |
| JP | 2013086245 | A | 5/2013 |
| JP | 2015009328 | A | 1/2015 |
| KR | 20020080592 | | 10/2002 |
| WO | WO-1991004449 | | 4/1991 |
| WO | WO-2008110148 | A2 | 9/2008 |
| WO | WO-2012117077 | A1 | 9/2012 |

OTHER PUBLICATIONS

"Japanese Application No. JP2018-538731, Notification of Reason(s) for Refusal dated Dec. 13, 2018", (dated Dec. 13, 2018), 16 pgs.

"Australian Application No. 2017210772, Examination Report No. 1 dated Aug. 23, 2018", (dated Aug. 23, 2018). 7 pgs.

"International Application No. PCT/CA2017/050093, International Preliminary Report on Patentability dated Feb. 20, 2018", (dated Feb. 20, 2018), 15 pgs.

"European Application No. 17743530.2, Extended European Search Report dated Jan. 21, 2019", (dated Jan. 21, 2019), 12 pgs.

* cited by examiner

ICE BLASTING SYSTEM AND METHOD

CROSS REFERENCE TO RELATED APPLICATION

This application is a U.S. national stage application filed under 35 U.S.C. § 371 from International Application Serial No. PCT/CA2017/050093, which was filed Jan. 27, 2017, and published as WO2017/127935 on Aug. 3, 2017, and which claims priority to U.S. Provisional Application Serial No. 62/287,742 filed Jan. 27, 2016, U.S. Provisional Application Serial No. 62/292,999 filed Feb. 9, 2016, U.S. Provisional Application Serial No. 62/294,161 filed Feb. 11, 2016, and U.S. Provisional Application Serial No. 62/294,710 filed Feb. 12, 2016, which applications and publication are incorporated by reference as if reproduced herein and made a part hereof in their entirety, and the benefit of priority of each of which is claimed herein.

TECHNICAL FIELD

The present invention relates to the field of ice blasting.

BACKGROUND

Ice blasting involves directing a stream of ice particles under high velocity and pressure against a surface for purposes of cleaning or removing portions of the surface. An apparatus for ice blasting is disclosed in U.S. Pat. No. 6,270,394.

Typically, as also shown in U.S. Pat. No. 6,270,394, ice blasting systems produce their own supply of ice. An onboard ice maker adds to the complexity, size, weight and cost of such systems and reduces portability as a connection to a source of water is required. There is a need therefore for an ice blasting system that overcomes at least some of the aforementioned disadvantages.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, devices, machines and methods which are meant to be exemplary and illustrative, not limiting in scope. In various embodiments, one or more of the above described problems have been reduced or eliminated, while other embodiments are directed to other improvements.

The present disclosure provides a method and system for ice blasting which uses supplied ice in bulk rather than producing its own ice supply. A particle sizer crushes the bulk ice to a smaller size suitable for entrainment into a stream of fluidizing agent, for example compressed air. A single-hose system may be used to increase the outlet velocity of the ice acting as the blast cleaning media and to decrease the weight and complexity of the blasting outlet. The single-hose system is able to further increase the velocity of the blast ice as it is mixed with the fluidizing agent prior to a converging-diverging nozzle, compared to a two-hose system which requires that the two streams combine after the converging-diverging nozzle to produce the Venturi effect.

The increase in velocity of the blast ice with the single hose system allows for more effective blasting due to the increase in kinetic energy. In addition to the exemplary aspects and embodiments described above, further aspects and embodiments will become apparent by reference to the drawings and by study of the following detailed descriptions.

One aspect of the disclosure is a blast cleaning system having a nozzle configured to deliver a pressurized blast cleaning media. The blast cleaning media includes a pressurized fluid and water ice particles as the primary blast cleaning component. The system includes an input hopper configured to accept supplied water ice in bulk form from an outside source. The system further includes a particle sizing module configured to produce the water ice particles for the pressurized blast cleaning media from the supplied water ice after the supplied water ice has been accepted into the input hopper.

Another aspect of the disclosure is a water ice particle delivery device having an input hopper configured to accept water ice supplied in bulk form from an outside source, wherein the volume of each piece of water ice is greater than 2 ml and less than 10,000 ml. The device has a particle sizing module coupled to the input hopper and configured to crush the water ice supplied in bulk form to create water ice particles and a single hose configured to deliver the created water ice particles.

Another aspect of the disclosure is a method of blast cleaning. The method involves accepting water ice supplied in bulk form into an input hopper, sizing the water ice supplied in bulk form by a particle sizing module coupled to the input hopper, wherein the sizing results in water ice particles of a size suitable for blast cleaning, mixing the water ice particles with a pressurized fluid in a mixing channel coupled to the particle sizing module to form a pressurized blast cleaning media, and delivering the pressurized blast cleaning media from the mixing channel through a hose, wherein the water ice particles provide the primary blast cleaning component.

BRIEF DESCRIPTION OF DRAWINGS

Exemplary embodiments are illustrated in the drawings. It is intended that the embodiments and figures disclosed herein are to be considered illustrative rather than restrictive.

DETAILED DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

In general, and by way of introduction and overview, the embodiments described in this disclosure relate to an ice blasting system and method in bulk ice is supplied from an external source rather than being produced internally. By eliminating the internal ice maker, the ice blasting system is smaller, lighter, simpler, and more portable. The ice blasting system has a particle sizer (or crusher) that shatters or crushes the bulk ice using a jaw-like mechanism having two opposed set of ice-crushing teeth. The sized particles are mixed into the stream of pressurized fluidizing agent, such as compressed air. In one embodiment, a single-hose system is used to increase the outlet velocity of the blast media and to decrease the weight and complexity of the blasting outlet. A pressurized media blasting system with a single-hose for use with blast media such as water ice confers advantages over conventional two-hose systems to deliver blast media to a target. The two-hose system uses a Venturi nozzle to combine the high-pressure fluidizing agent and the blast media before the blasting outlet. The single-hose system is superior to the two-hose system in regards to the increased outlet velocity of the blast media and the decreased weight and complexity of the blasting outlet. The single-hose system is able to further increase the velocity of the blast media as it is mixed with the fluidizing agent prior to a converging-diverging nozzle, whereas the two-hose system requires that two streams combine after the converging-diverging nozzle to produce the Venturi effect. The increase in velocity of the blast media with the single hose system allows for more effective blasting due to the increase in kinetic energy.

Figure 1:
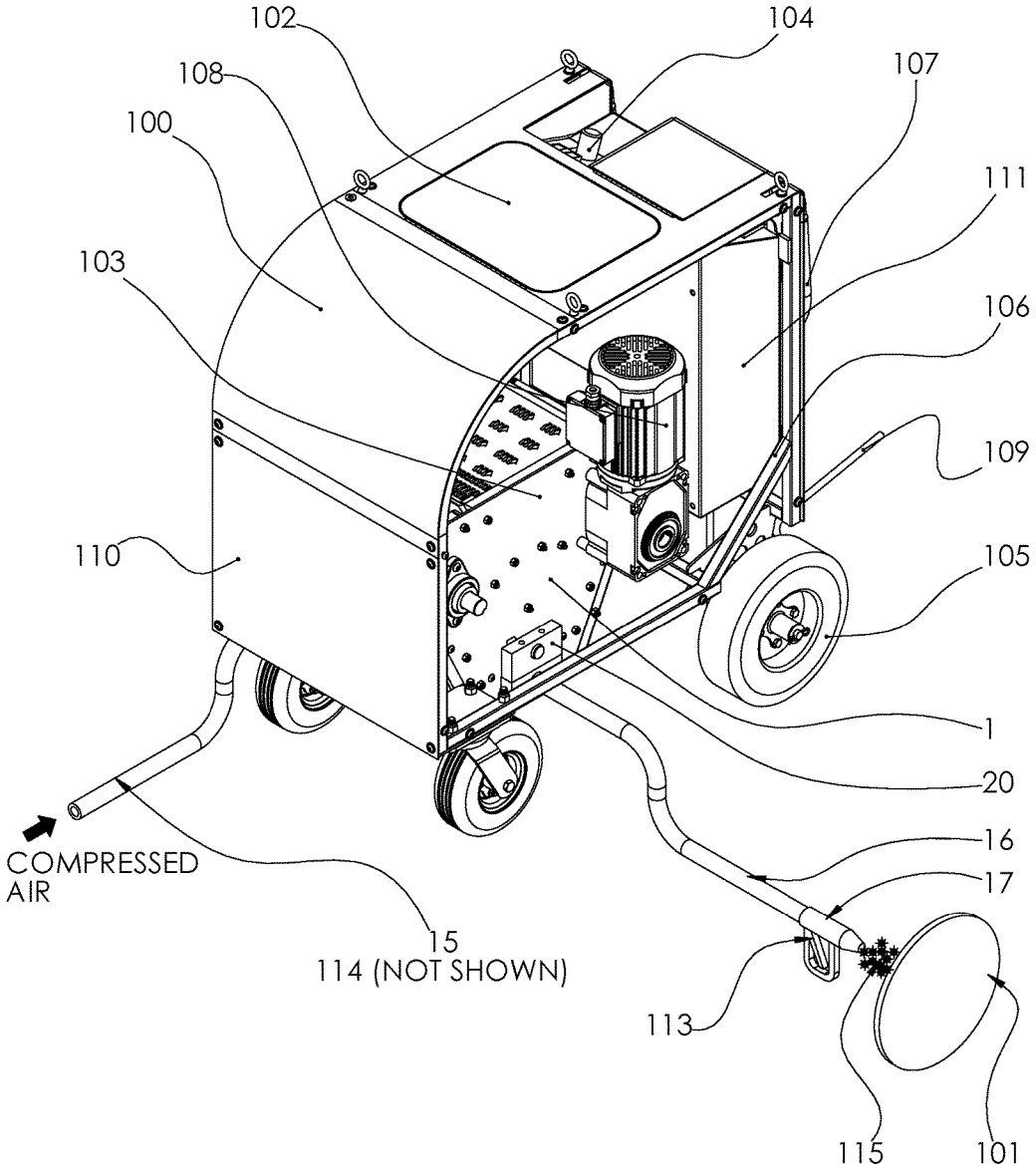
FIG. 1 is an isometric view of a ice blasting system according to a first embodiment, shown with its side cover panel removed.
Figure 3:
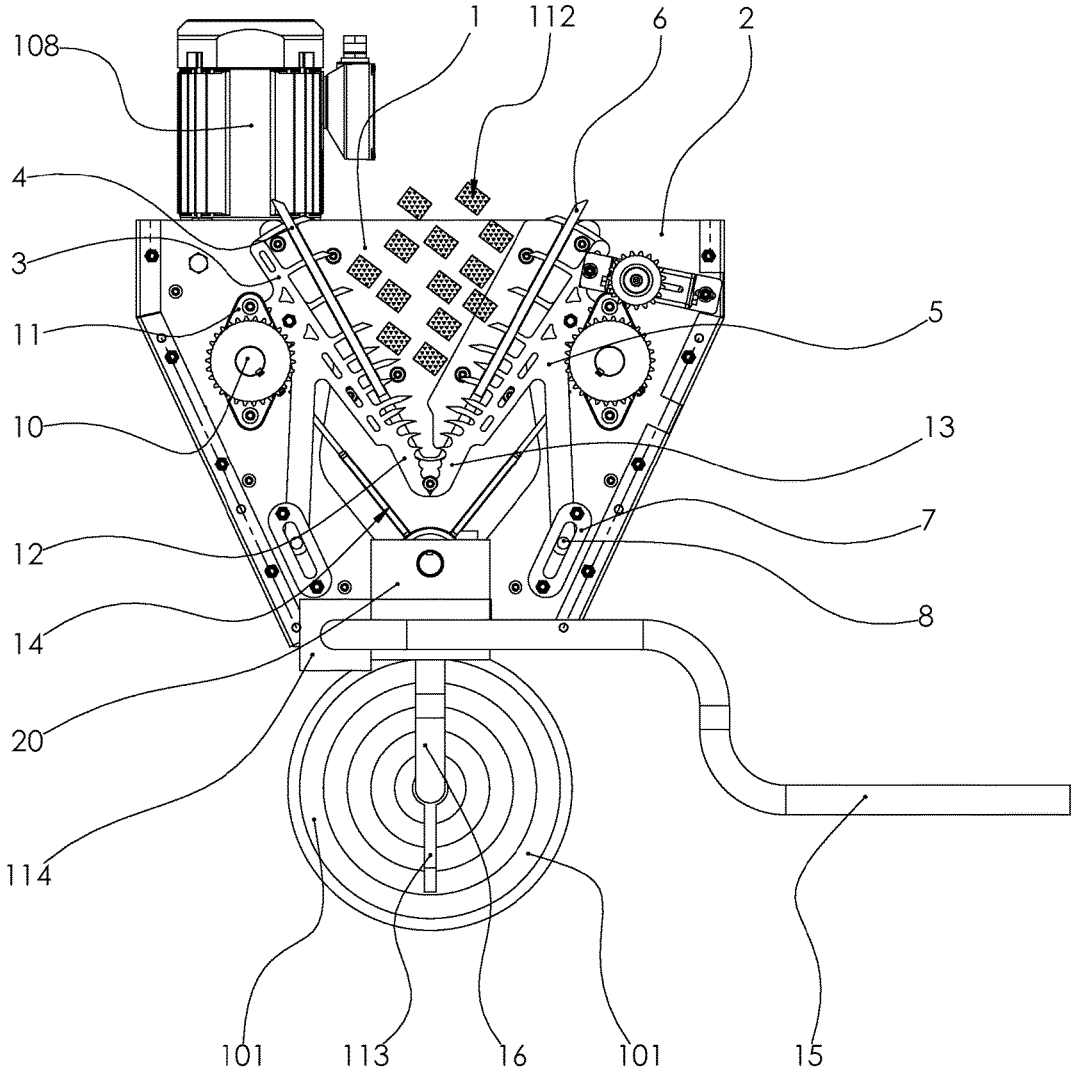
FIG. 3 is side elevation view of the particle sizing module and pressure feeder module shown in FIG. 2.

FIG. 1 shows an ice blasting system 100 (also referred to herein as an ice blast machine) in accordance with an embodiment of the invention. The ice blasting system 100 is shown with a side cover panel removed for illustration. The ice blasting system 100 receives a supply of ice that is made or formed outside of the system. The ice blasting system includes a frame 106 and cover panels 110 (defining a housing). Wheels 105 and a handle 107 may be attached to the frame for mobility and portability. An electrical box 111 houses all of the electrical control and power circuits. Control panel 104 is provided for machine control functions such as On/Off, emergency stop and ice feed rate selection. The ice blast machine (i.e. ice blasting system) is supplied with electric power via a power supply cable 109 although in another embodiment, the electric power may be generated by an onboard generator. In the illustrated embodiment, compressed air is supplied to the machine via a compressed air supply hose 15 which may optionally be a detachable hose. In another embodiment, the machine may include an air compressor. Supplied unsized ice 112 (as shown in FIG. 3) is loaded into an ice storage hopper 103 via an ice hopper door or hatch 102 disposed on an upper surface of the housing of the ice blast machine. The supplied ice 112 may be in the form of blocks or cubes or random sized and shaped chunks of ice. For example, in one embodiment, the supplied ice has a volume in a range of 2 ml to 10,000 ml. A blast hose 16 connects the ice blast machine 100 to a blast nozzle 17. The nozzle may be a handheld nozzle as shown in the figures although in other embodiments the nozzle may be mounted to any suitable platform, gantry, robotic manipulator arm, or other user-controllable apparatus. To perform blasting operations against a target surface 101 using the handheld nozzle shown in the figures, the operator squeezes the blast trigger 113 to activate the pneumatic system 114 and drive motor 108. The drive motor 108 rotates both a particle sizing module 1 (also referred to herein as a "crusher") and the pressure feeder module 20. The particle sizing module 1 (i.e. the crusher) converts bulk ice 112 from a variety of sources and forms (e.g. cube, block, etc.) by crushing the bulk ice into a multitude of smaller sized ice particles 115 with a suitable size, or within a range thereof, for use as a blast media to perform blast cleaning applications. The pressure feeder module enables the air particles to be entrained in a stream of compressed air thereby producing a compressed air and ice particle mixture which is supplied through the blast hose 16 to the blast nozzle 17 where the blast mixture is accelerated and propelled against the target surface 101 to perform industrial cleaning applications.

Figure 2:
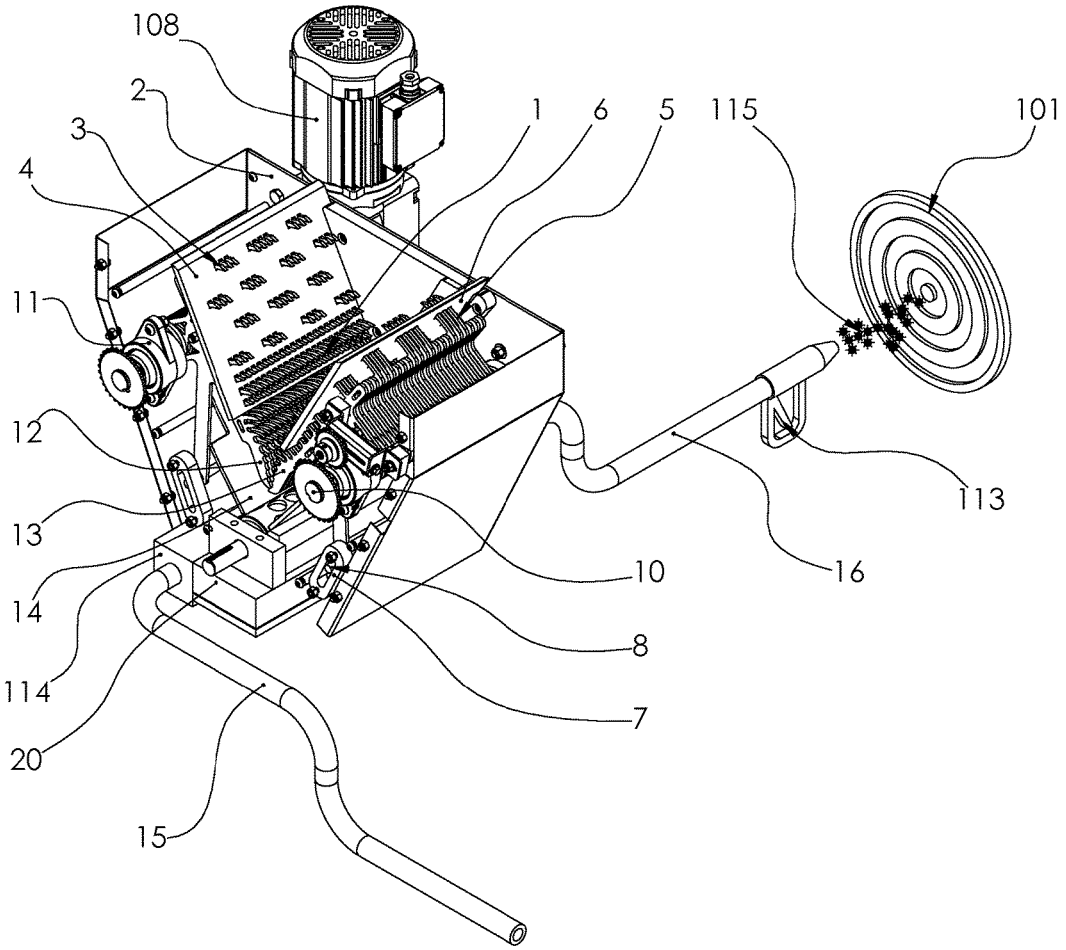
FIG. 2 is an isometric view of a particle sizing module and pressure feeder module of the ice blasting system shown in FIG. 1.
Figure 4:
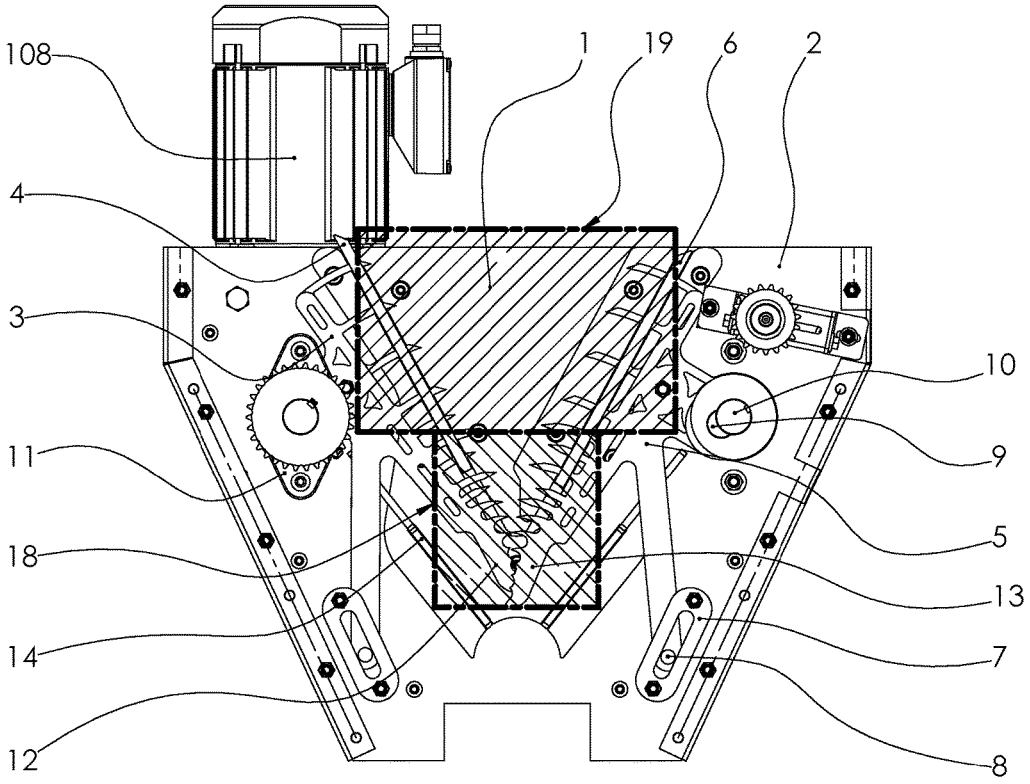
FIG. 4 is a side elevation view of the particle sizing module shown in FIG. 2, shown in a closed position.

FIG. 2 shows an isometric view of the particle sizing module 1 and pressure feeder module 20 with a side plate removed for illustration, as described in further detail below. FIG. 3 illustrates an elevation view of the particle sizing module 1 and pressure feeder module 20 with a side plate removed for illustration, as described in further detail below. As illustrated in FIG. 2 and FIG. 3, the particle sizing module (crusher) has a V-shaped jaw formed of two angled sets of ice-crushing teeth. The particle sizing module 1 with a side panel removed for illustration is further illustrated in FIG. 4 through 7. FIG. 4 shows the particle sizing module 1 in its "Closed" motion state. The particle sizing module 1 converts supplied unsized ice 112 from a variety of sources and forms (cube, block, etc.) into a multitude of ice particles 115 with an optimum size for use as a blast media to perform blast cleaning applications. The particle sizing module 1 includes two side plates 2 which form the lower sides of the ice storage hopper 103. The module includes two opposed crushing teeth assemblies 3 and 5 which face opposed to one another and between which block or cube ice is deposited into the ice storage hopper 103. The first assembly is comprised of an array of tooth plates 3 which are driven by sizer drive shafts 10, rotating within sizer bearings 11 which, in turn, rotate an eccentric shaft 9. The eccentric shaft 9 imparts a planetary motion to the tooth plates 3. The bottom of the tooth plates 3 are affixed to a tooth plate cam 8 which slides within a tooth plate guide 7 to add a linear motion component to the planetary motion. The two motions together induce a slider-crank motion to the tooth plates 3. The tooth plate 3 teeth slide within a perforated cleaner plate 4 which acts to remove residual ice from between the teeth 3 to prevent clogging of the mechanism.

The second teeth assembly 5 is similar, but opposite in orientation to the first assembly 3 and offset by one tooth, with the second assembly 5 including an array of tooth plates 5 and its corresponding cleaner plate 6. Cleaner plates 4 and 6 differ in the size and arrangement of their respective teeth. The pitch of the teeth on each tooth plate 3, 5 is arranged to produce a crushing force on the ice when it is forced between the oscillating tooth arrays. The size of the resultant ice media is determined by the pitch of the teeth on each tooth plate 3, 5 as well as the spacing between the individual tooth plates on each array. By "crushing force", it is understood that the opposing teeth exert a compressive force on the ice, causing compressive fracturing of the ice, thereby producing smaller particles of ice suitable for blasting.

Figure 5:
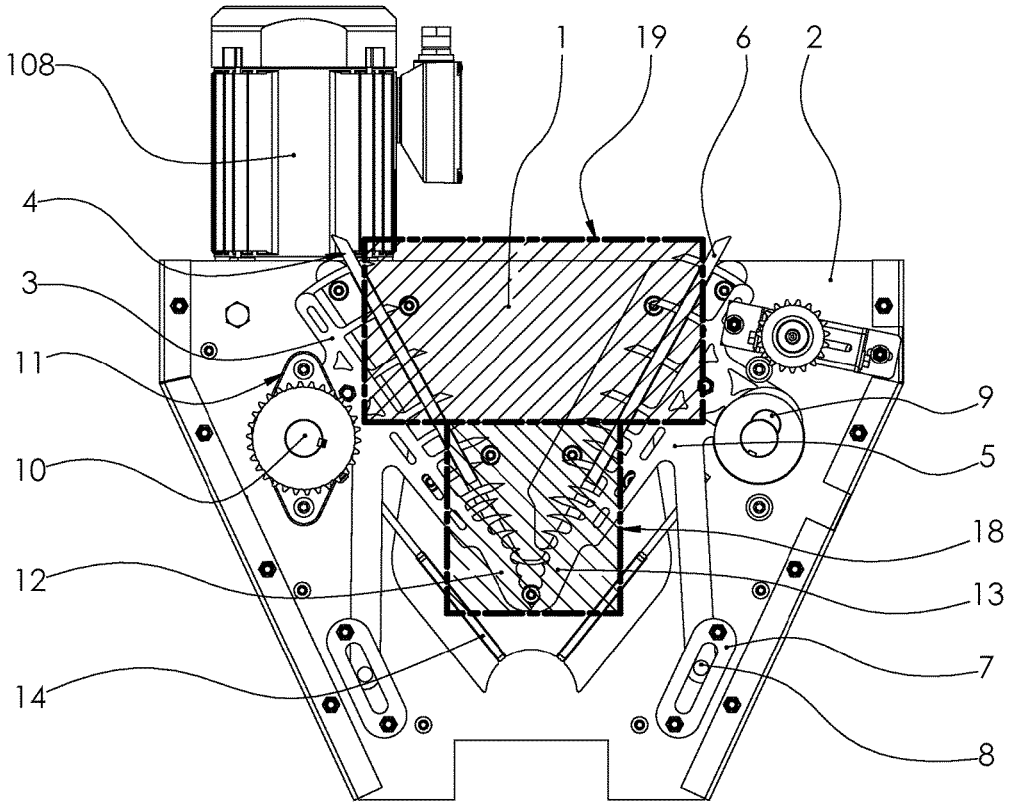
FIG. 5 is a side elevation view of the particle sizing module shown in FIG. 2, shown in an open position.
Figure 6:
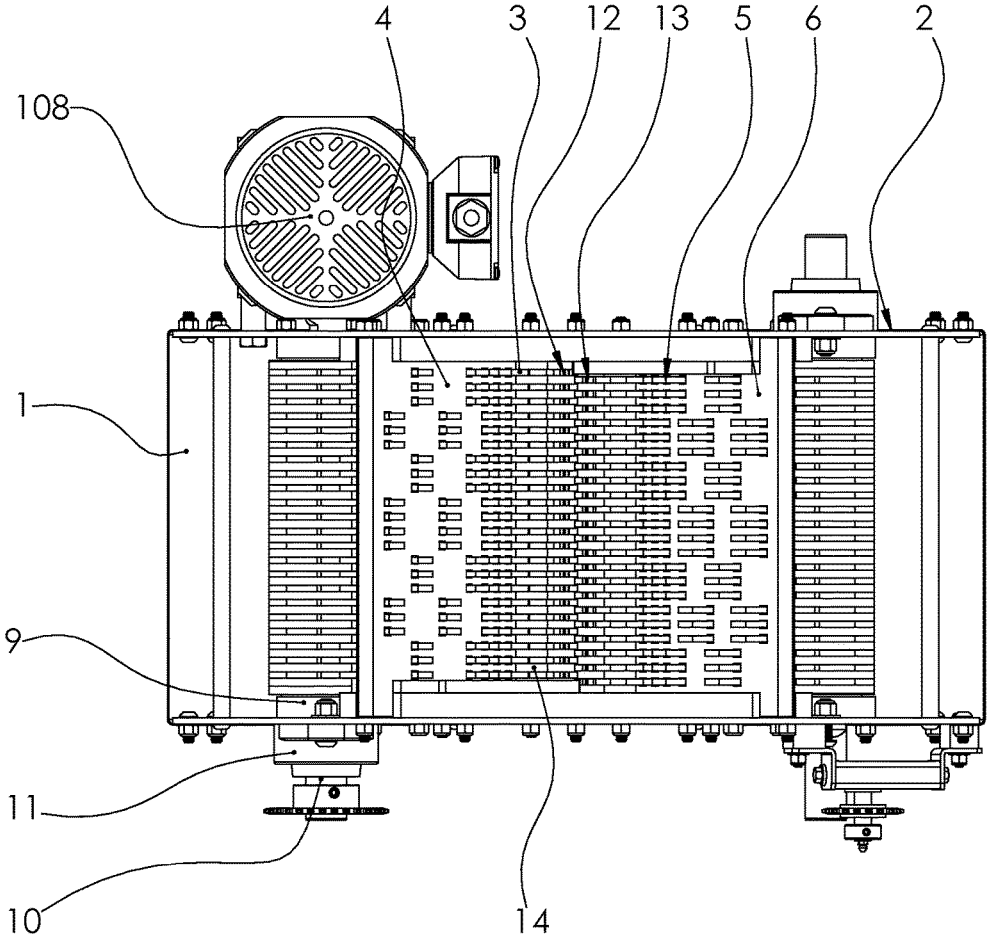
FIG. 6 is a top plan view of the particle sizing module shown in FIG. 2, shown in the open position.
Figure 7:
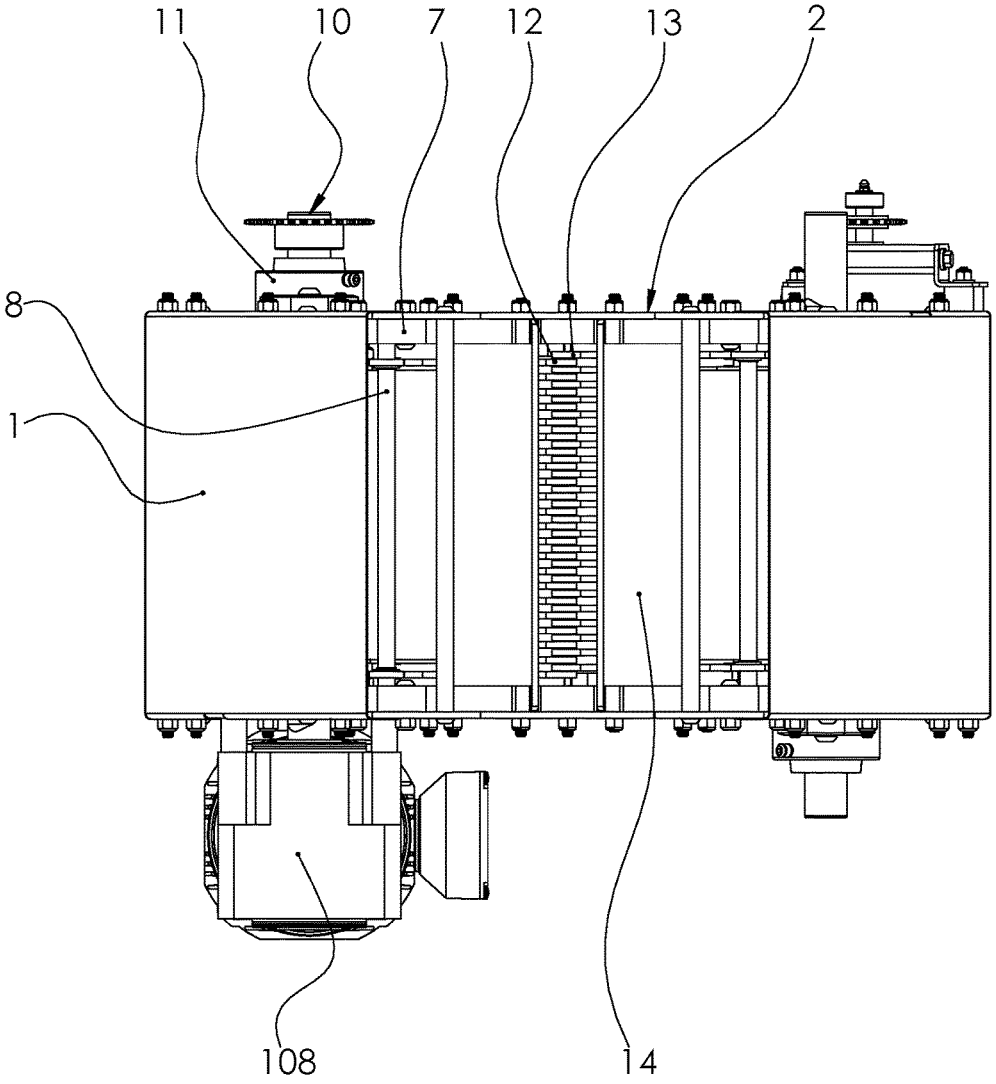
FIG. 7 is a bottom plan view of the particle sizing module shown in FIG. 2, shown in the closed position.

FIG. 5 illustrates an elevation view of the particle sizing module 1 in its "Open" motion state (i.e. open position) and FIG. 4 shows an elevation of the particle sizing module 1 in its "Closed" motion state (i.e. closed position). The continuous cyclical transition from the "Open" to "Closed" motion states causes the bulk ice to be crushed into smaller and smaller bulk sizes as it drops between the teeth arrays until ice particles are produced which are of a size suitable for blast cleaning applications. For example, in one embodiment, the ice particles are less than 2 ml in volume. The motion of the arrays of teeth causes a top-to-bottom motion to induce the ice to move towards the bottom of the particle sizing module 1 where it encounters the bottom teeth 13 of each array. The bottom teeth of each array also force the ice into the ice load zone 19 located above the pressure feeder module 20. FIG. 6 illustrates a top plan view of the particle sizing module 1 in its "Open" motion state. FIG. 7 shows a bottom plan view of the particle sizing module in its "Closed" motion state.

Figure 8:
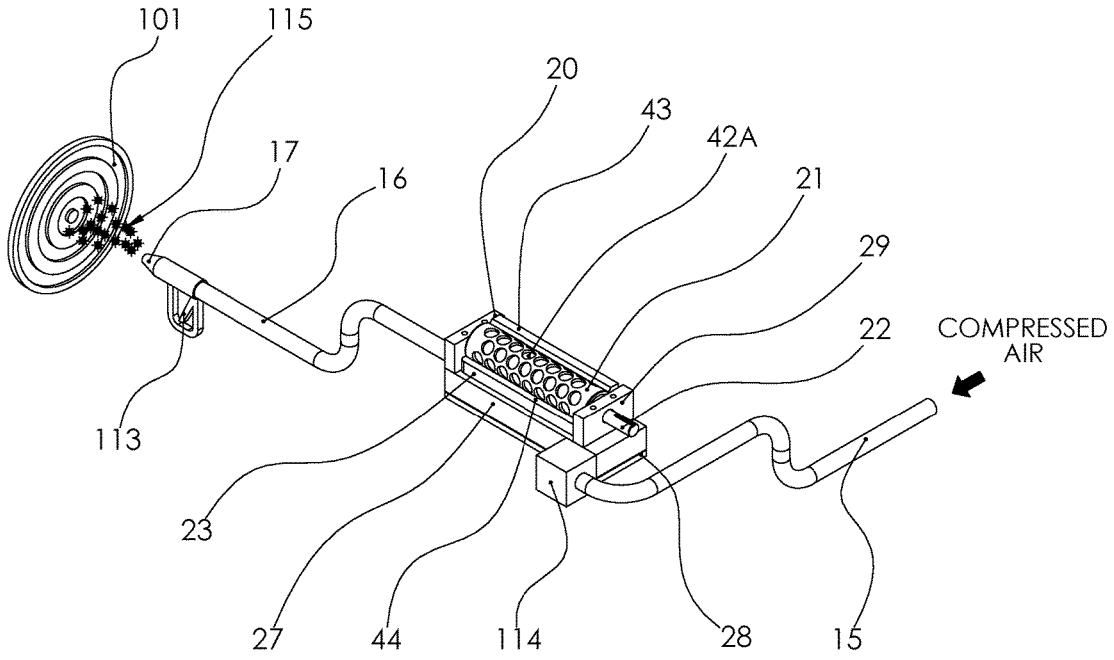
FIG. 8 is an isometric view showing the pressure feeder module of the embodiment shown in FIG. 1 with attached hoses.
Figure 9:
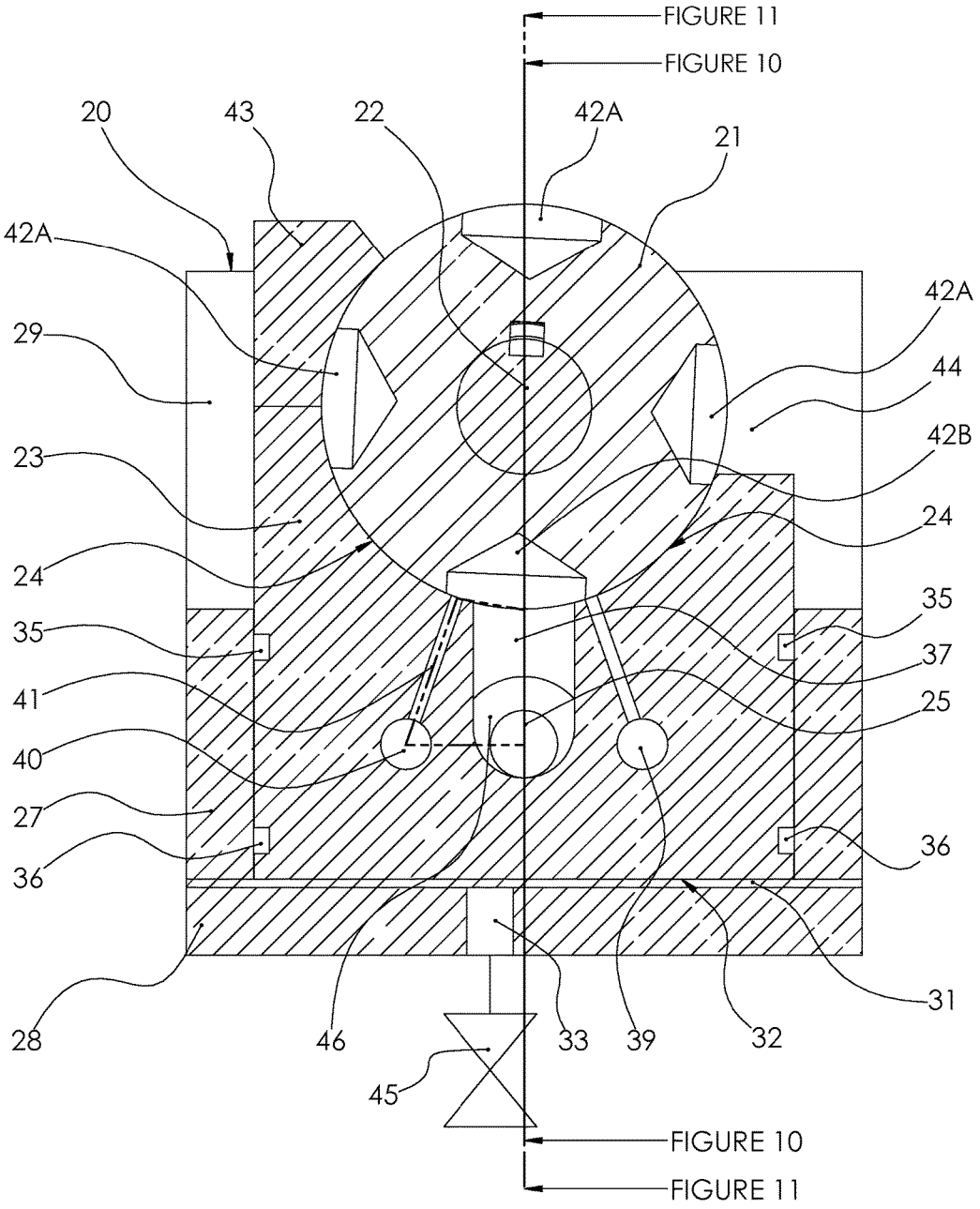
FIG. 9 is a longitudinal sectional view of the pressure feeder module shown in FIG. 8.
Figure 10:
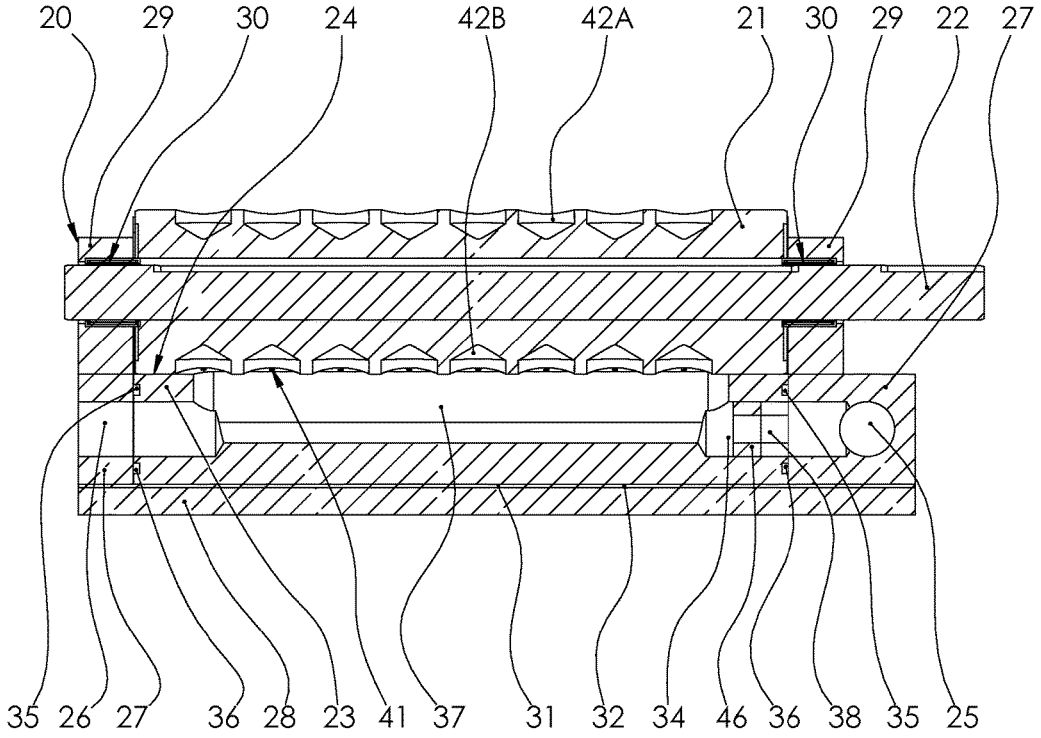
FIG. 10 is an axial sectional view of the pressure feeder module shown in FIG. 8.
Figure 11:
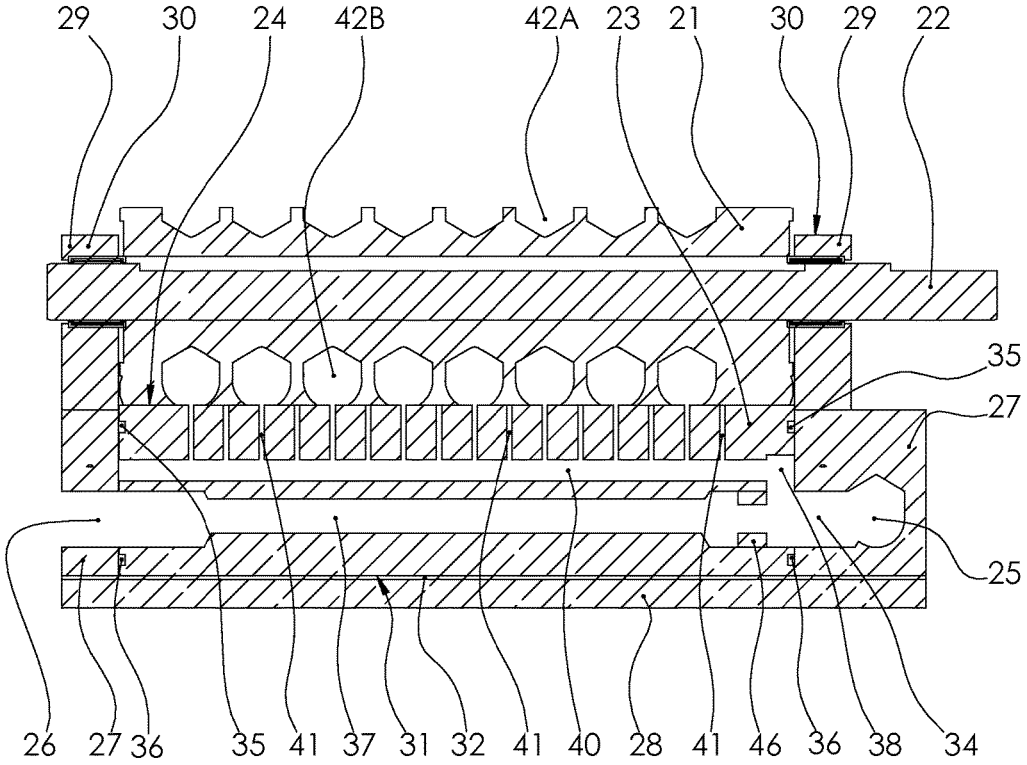
FIG. 11 is a sectional view of the pressure feeder module shown in FIG. 8 through jet conduit, cleaner jets and the ice mixing channel.

The pressure feeder module 20 in accordance with one embodiment is illustrated in FIG. 8 through 11. FIG. 8 shows the pressure feeder module 20 in isolation with attached hoses. FIG. 9 shows a longitudinal section through the pressure feeder module 20. FIG. 10 shows an axial section through the pressure feeder module. FIG. 11 shows a longitudinal section of the pressure feeder module through the jet conduit 39, the cleaner jets 41 and the ice mixing channel 37. The pressure feeder module 20 transfers the ice particles 115 produced in the particle sizer module from an atmospheric air pressure state into a high pressure stream of compressed air to perform blast cleaning applications. The pressure feeder module 20 comprises a rotor 21, the surface of which has an arrangement of rotor pockets 42. This rotor is supported by a rotor drive shaft 22 which is supported at each end of the rotor by a bearing 30 mounted in a bearing block 29. The bearing blocks 29 are mounted at each end of a pressure block 27 which positions a seal block 23 under the rotor. A rubber or composite pneumatic bladder 31 is mounted between the pressure block 27 and the base plate 28. A compressed air supply hose 15 is connected to the air inlet 25 to provide a source of compressed air. The blast nozzle 17 is connected via the blast hose 16 to the ice blast outlet 26.

During operation, compressed air is fed into air inlet 25 via the compressed air supply hose, pressurizing the ice mixing channel 37, the jet conduit header 38, jet conduit 39, jet conduit 40, cleaner jets 41 and the ice blast outlet 26. These sections comprise the pressure chamber 34. Compressed air flow between the jet conduit header 38, and the ice mixing channel 37 is controlled by a self-adjusting flow regulator 46. This regulator ensures that adequate air flow is maintained through the cleaner jets 41 during low-pressure blasting operations by restricting the air flow directly from the jet conduit header 38 to the pressure chamber 34. The pressure chamber 34 is maintained between the pressure chamber upper seal 35 and pressure chamber lower seal 36 to allow the seal block 23 to move in a vertical path between the rotor 21 and the pneumatic bladder 31. The compressed air flows through the pressure chamber 34 and through the blast nozzle 17 via the blast hose 16.

During operation, ice particles 115 settle under gravity into the rotor pockets 42A in the atmospheric ice load zone 19, maintained at atmospheric pressure, within the ice storage hopper 103. The rotor 21 is continuously rotated by the rotor drive shaft 22, moving the rotor pockets 42B containing the ice particles 115 past the ice fence 43 into the pressure chamber 34. A variety of rotor pocket pattern arrangements may be used to vary the blast media feeding properties to the nozzle. The ice fence 43 holds the ice particles 115 within the atmospheric rotor pocket 42A to carry it towards the pressure chamber 34. As the rotor 21 rotates into the pressure chamber 34, the individual rotor pockets (pressurized) 42B become pressurized with the compressed air. The ice particles 115 are deposited into the ice mixing channel 37 by gravity and air flow through the ice mixing channel 37 and the cleaner jets 41. The cleaner jets 41 move a portion of the compressed air by air flow division through each individual pressurized rotor pocket as it both enters and exits the pressure chamber 34 to dislodge and remove any ice particles 115. The entrained ice particles 115 are accelerated through the blast nozzle 17 towards the target surface 101 via the blast hose 16. The rotor 21 continues to rotate and the pressurized rotor pocket 42B vents its compressed air load into the vent zone 44 to become an atmospheric rotor pocket 42A. The vented rotor pocket 42A continues to rotate to the atmospheric ice load zone 19 within the ice storage hopper 103.

During operation, a seal surface 24 between the rotor 21 and the seal block 23 is maintained by an upwards force on the seal block 23 against the rotor 21 generated by pneumatic bladder 31 located within the bladder chamber 32. The air pressure maintained within the pneumatic bladder 31 may be adjusted via an air pressure regulator 45 connected to the bladder air inlet 33. This allows the upward forces generated by the pneumatic bladder 31 to be adjusted to balance the downward forces generated by the pressure chamber 34 to minimize frictional forces on the rotor 21. The pneumatic bladder 31 keeps the force on the pressure block 27 constant even with wear on the pressure block or the rotor 21. The bladder pressure can be regulated in different manners. If the main incoming air pressure is relatively constant then a manually adjustable regulator can be used. If the main air pressure varies considerably then the bladder air pressure can be adjusted so that it is proportional to the air supply to keep the pressure block 27 force on the rotor relatively constant in spite of varying main air supply pressure. The pressure chamber upper and lower O-ring seals 35, 36 not only allow the pressure block to ride freely up and down but they act as secondary seals for the pneumatic bladder 31 in the event of a bladder rupture. The rotor 21 has a plurality of pockets or slots that are staggered or helically arranged so that there is always at least several pockets being emptied on the rotor at every angle. Air is always able to pass through the block from inlet 25 to outlet 26 and entrain the ice falling from the rotor 21. At no point is the air flow blocked. Air is directed up to each pocket 42A through the ice mixing channel 37 along with the air turbulence to help empty each (pressurized) rotor pocket 42B. The orifice plug 46 creates a differential pressure for the jet conduit header 38 to operate the jet conduits A and B denoted by reference numerals 39, 40. This orifice plug 46 may be adjustable or interchangeable. The particle sizing module and the pressure feeder module can be mechanically coupled together with a chain, belt or gear system. Alternatively, they can be electrically coupled with two VFDs (Variable Frequency Drives). In the illustrated embodiments, both modules are operated together at the same speed. For example, if the particle sizing module 1 increases in speed, the pressure feeder module 20 must turn proportionally faster to take away the particles and prevent any accumulation which will cause plugging of the system. Together the speed of the particle sizing module 1 and the pressure feeder module 20 control the ice particle delivery rate which may be set by the operator for the task at hand. The speed may be adjusted continuously or fixed for a specific application. For example, the speed may be controlled by any suitable dial, lever, button, toggle, or other user input device disposed on the handheld nozzle or on the exterior housing of the ice machine.

Figure 12:
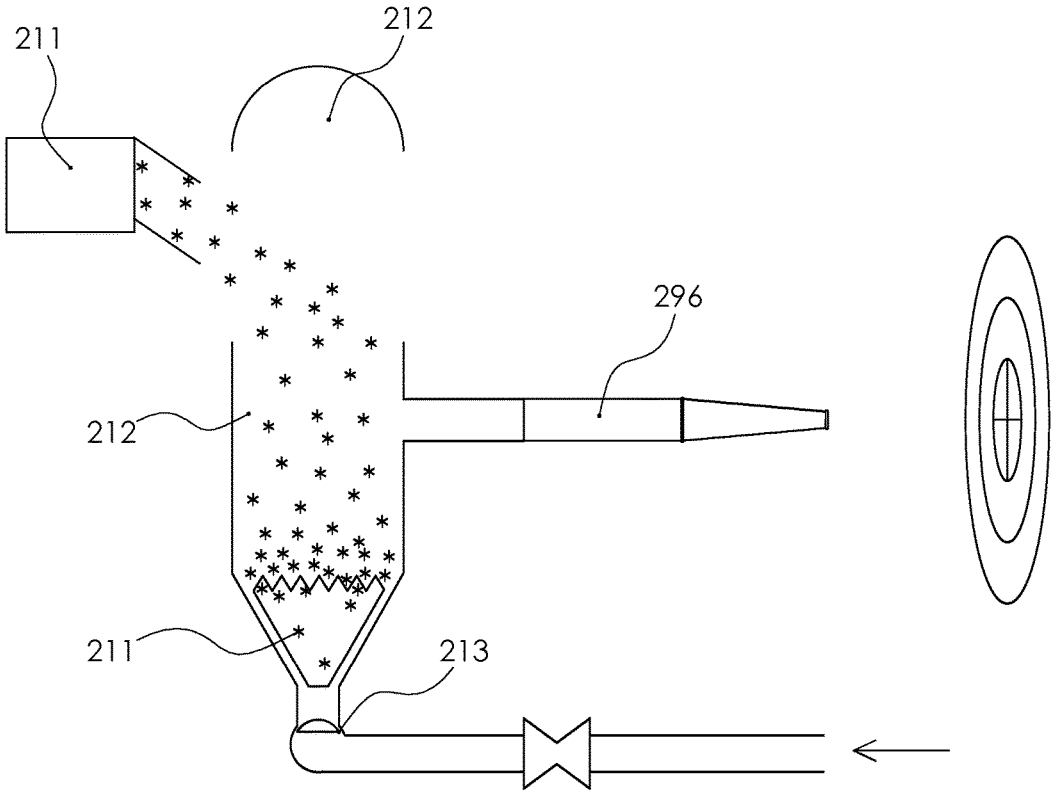
FIG. 12 is a schematic diagram illustrating an ice blasting system according to a further embodiment of the invention, with the ice retainer in the closed position.
Figure 13:
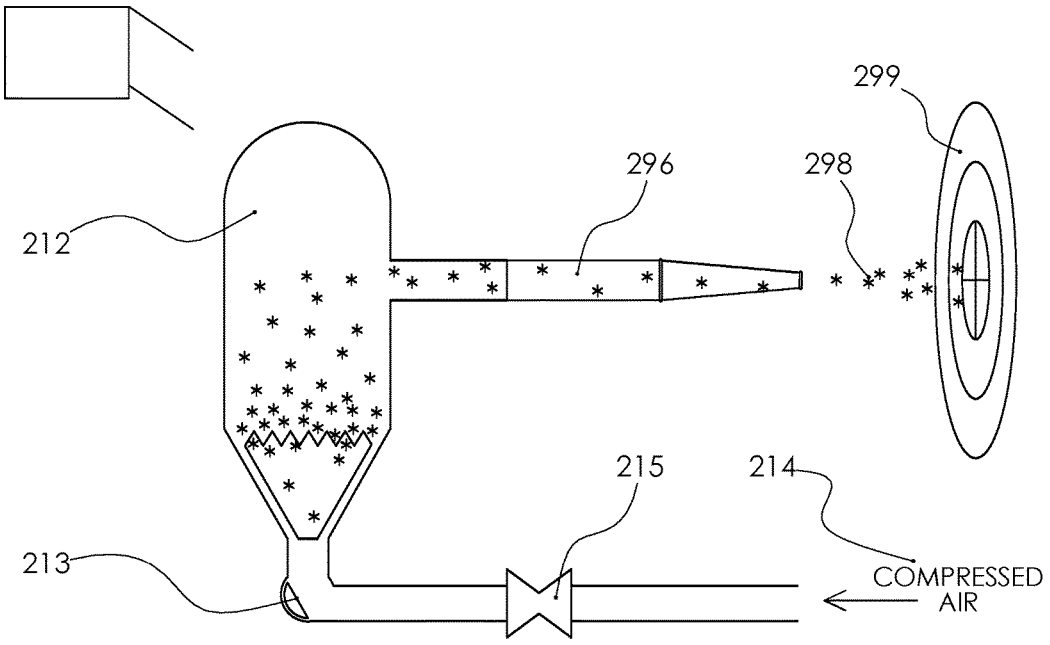
FIG. 13 is a schematic diagram illustrating the ice blasting system shown in FIG. 12 with the ice retainer 13 in the open position.
Figure 14:
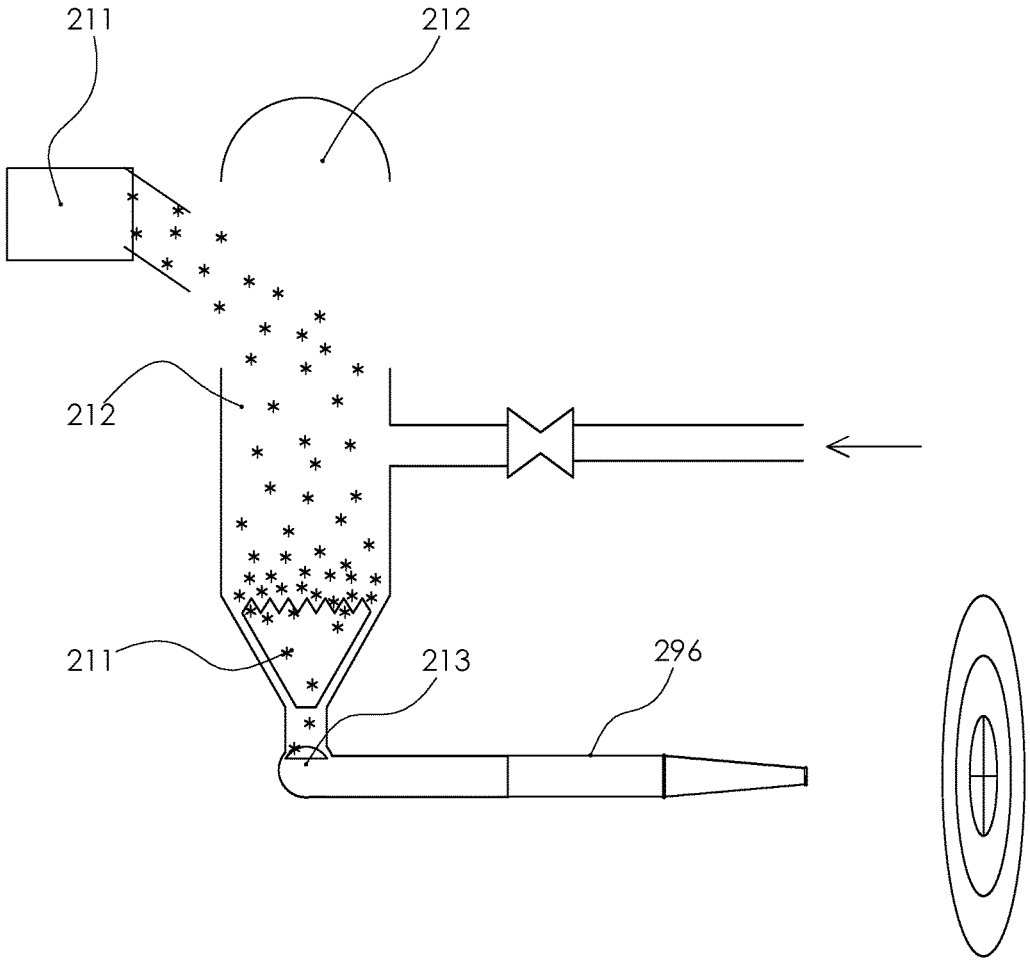
FIG. 14 is a schematic diagram illustrating an ice blasting system according to a further embodiment of the invention with the ice retainer in the closed position.
Figure 15:
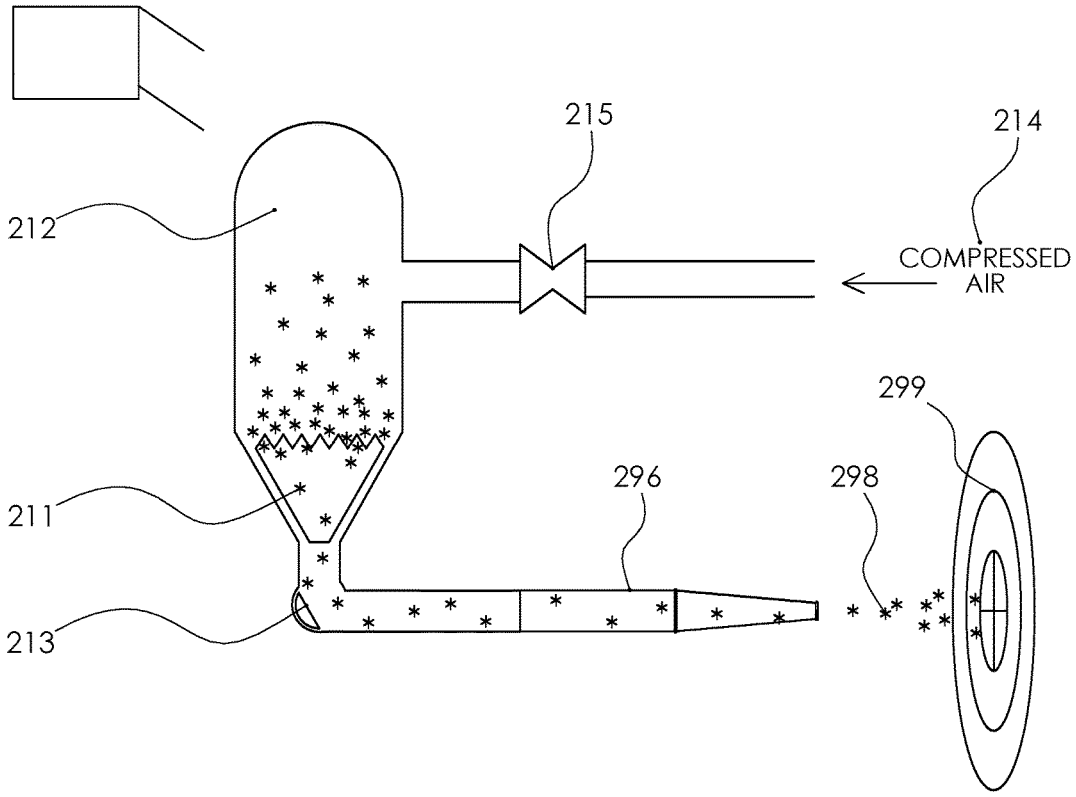
FIG. 15 is a schematic diagram illustrating the ice blasting system shown in FIG. 14 with the ice retainer 13 in the open position.

FIG. 12-26 illustrate further embodiments of the means for feeding sized ice particles into the flow of pressurized fluidizing agent. In FIG. 12, the premade blast media 211 such as water ice is deposited into the open media chamber 212 with the media retainer 213 in the closed position. Once the media chamber is filled with the blast media, the chamber 212 is resealed as shown in FIG. 13. The media retainer 213 is moved to the open position and the fluidizing agent 214 enters the media chamber under pressure from underneath the media and is controlled via inlet valve 215. The fluidizing agent may be particulate ice fluidized with pressurized air. It may also be a water-ice mixture delivered under pressure, or just water under pressure. The fluidizing agent engages with the media inside the media chamber 212 and propels the blast media mixture 298 through hose 296 towards the target 299. In the embodiment depicted in FIG. 14, the premade blast media 211 is deposited into the open media chamber 212 with the media retainer 213 in the closed position. Once the media chamber is filled with the blast media, the chamber 212 is resealed as shown in FIG. 15. The media retainer 213 is moved to the open position and the fluidizing agent 214 enters the media chamber 212 under pressure from above the media and is controlled via the inlet valve 215. The fluidizing agent engages with the media inside the media chamber and propels the blast media mixture 298 through hose 296 towards the target 299.

Figure 16:
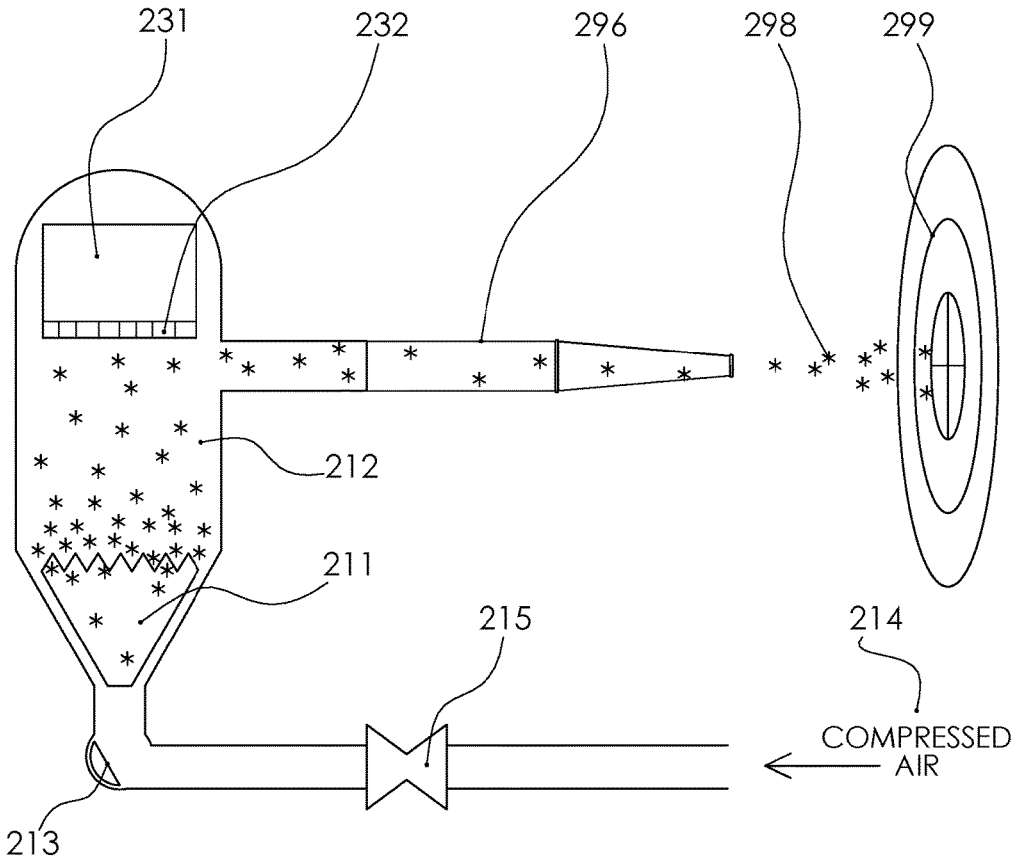
FIG. 16 is a schematic diagram illustrating an ice blasting system according to a further embodiment of the invention.

In the embodiment depicted in FIG. 16, bulk media 231 such as a block or granules, is placed inside the media chamber 212 and the chamber is resealed. Blast media 211 is then produced from the bulk using a destructive method performed by system 232 to transform the bulk media 231 into the specified media size. The blast media 211 is retained within the bottom of the media chamber with the media retainer 213 in the closed position. Once sufficient initial media has been produced inside the media chamber 212, the media retainer 213 is set to the open position shown in FIG. 16 and the fluidizing agent 214 enters the media chamber via the inlet valve 215 from below the media. The fluidizing agent engages with the prepared media within media chamber 212, fluidizing and propelling the blast media mixture 298 through hose 296 towards the target 299. This system can either continuously produce media while the blasting procedure is taking place or alternate between blasting and media production modes.

Figure 17:
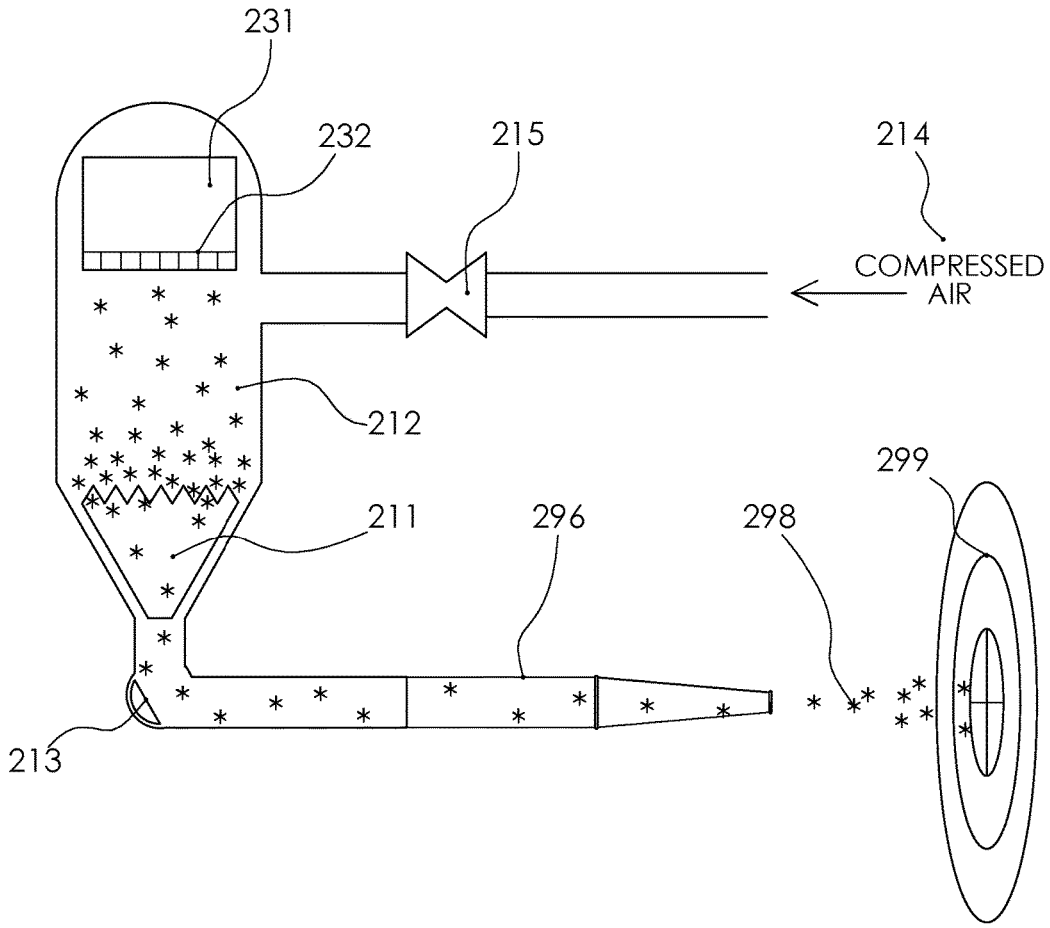
FIG. 17 is a schematic diagram illustrating an ice blasting system according to a further embodiment of the invention.

In the embodiment depicted in FIG. 17, bulk media 231 such as a block or granules, is placed inside the media chamber 212 and the chamber is resealed. Blast media 211 is then produced from the bulk media using a destructive method performed by system 232 to transform (i.e. resize) the bulk media 231 into the specified media size. The blast media 211 is retained within the bottom of the media chamber with the media retainer 213 in the closed position. Once sufficient initial media has been produced inside the media chamber 212, the media retainer 213 is set to the open position as shown in FIG. 17 and the fluidizing agent 214 enters the media chamber via the inlet valve 215 from above the media. The fluidizing agent engages with the prepared media within media chamber 212, fluidizing and propelling the blast media mixture 298 through hose 296 towards the target 299. This system can either continuously produce media while the blasting procedure is taking place or alternate between blasting and media production modes.

Figure 18:
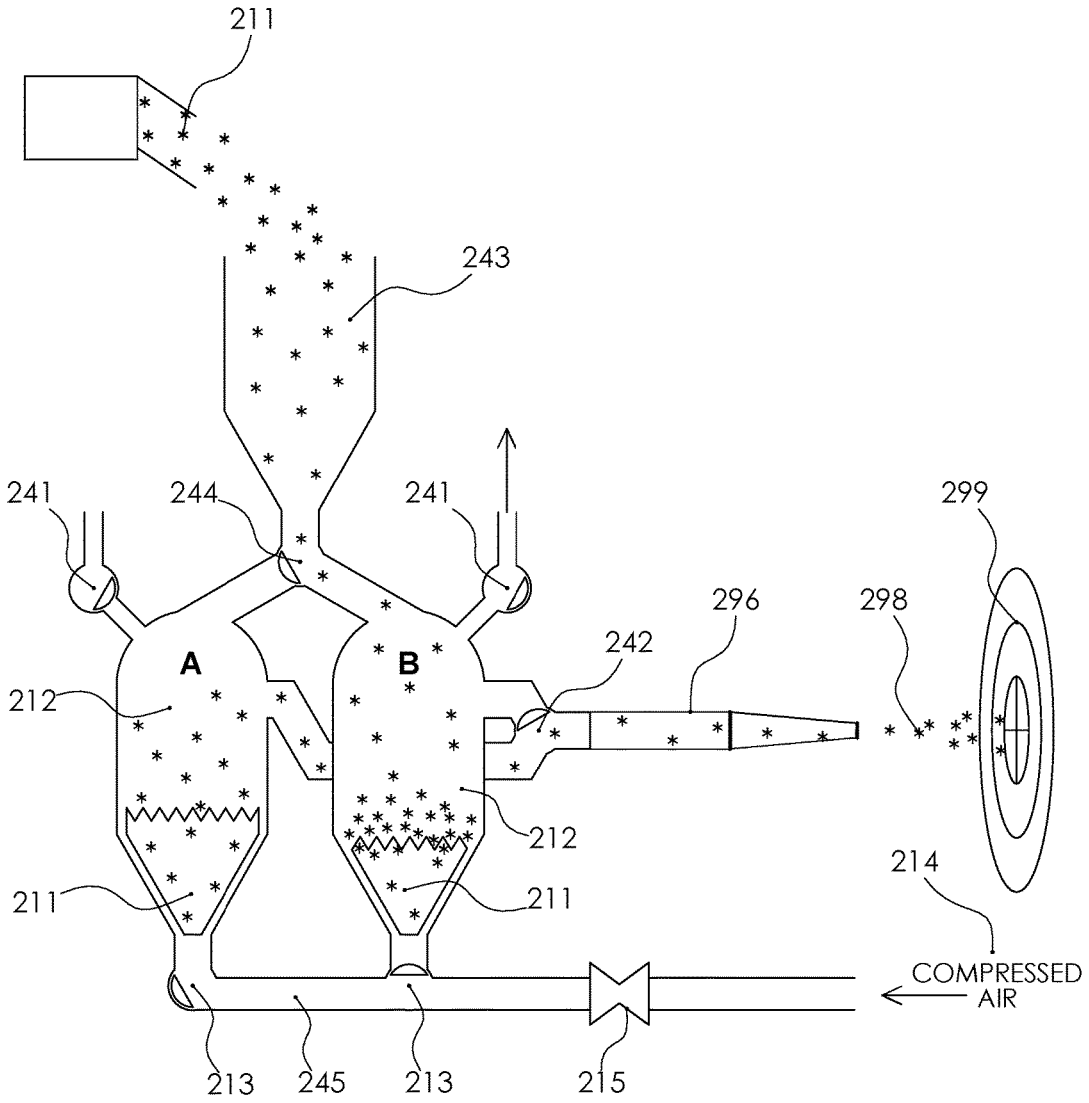
FIG. 18 is a schematic diagram illustrating the mixing chamber of an ice blasting system according to a further embodiment of the invention.
Figure 19:
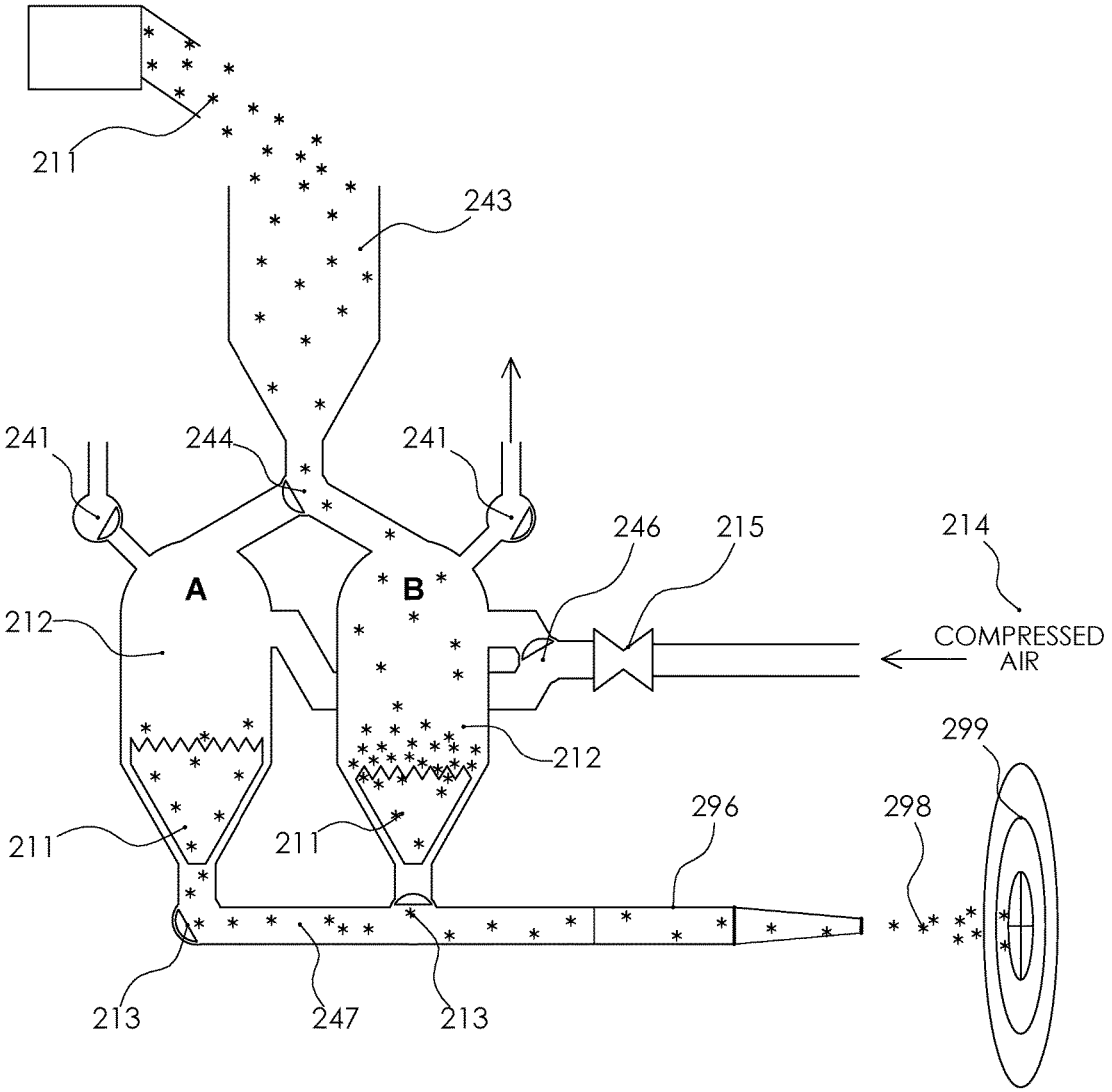
FIG. 19 is a schematic diagram illustrating an ice blasting system according to a further embodiment of the invention.

FIG. 18 and FIG. 19 represent a twin chamber blasting device where the two chambers alternate between blasting mode and blast media refill mode. While one chamber is in blasting mode, the other is in blast media refill mode. Once the chamber in blasting mode has exhausted its blast media, the two chambers switch modes for continuous blasting and refilling of blast media. The refilling mode in the following paragraphs depicts an automated refilling mechanism where a central hopper is used to distribute the media amongst the individual chambers. The refilling mode is not solely limited to this method and also includes other methods of media replenishing such as the manual refilling as shown in FIG. 12-15, the media refinement as shown in FIGS. 16-17, and the media production as shown in FIG. 20-23.

In the embodiment depicted in FIG. 18, both chamber A and chamber B initially start in the blast media refill mode where media retainers 213, relief valves 241, and outlet valve 242 are set to the closed position. First, the blast media 211 is fed into the top hopper 243 and the feeder valve 244 diverts the blast media into chamber A's mixing chamber 212 whose relief valve is set to the open position. Once sufficient media resides in chamber A, the relief valve 241 is closed and the feeder valve 244 diverts the blast media to begin filling chamber B's mixing chamber with blast media 211, as shown in FIG. 18. While Chamber B starts the refill mode, chamber A is switched into blasting mode where the outlet valve 242 and media retainer 213 are set to the open position and a fluidizing agent 214 enters the chamber from below the media via manifold 245 and inlet valve 215. The fluidizing agent engages with the media within media chamber 212, fluidizes it to become blasting mixture 298 and propels it through the outlet valve 242 through conduit 295 and hose 296 towards the target 299. Once sufficient media resides in chamber B, the refill mode is stopped and the relief valve 241 is closed and the feeder valve 244 is set to the all closed position. Once the blast media 211 in chamber A is exhausted, chamber A switches to blast media refill mode where the media retainer 213 and outlet valve 242 are set to the closed position and the blast media refilling begins. While this happens, chamber B is transferred to blasting mode. This process repeats to provide continuous refilling of blast media and the flow of pressurized blast media towards the target.

In the embodiment depicted in FIG. 19, both chamber A and chamber B initially start in the blast media refill mode where media retainers 213, relief valves 241, and inlet valves 246 are set to the closed position. First, the blast media 211 is fed into the top hopper 243 and the feeder valve 244 diverts the blast media into chamber A's mixing chamber 212 whose relief valve 241 is set to the open position. Once sufficient media resides in chamber A, the relief valve 241 is closed and the feeder valve 244 diverts the blast media to begin filling chamber B's mixing chamber with blast media 211, as shown in FIG. 19. While Chamber B starts the refill mode, chamber A is switched into blasting mode where the inlet valve 246 and media retainer 213 are set to the open position and a fluidizing agent 214 enters the chamber from above the media via the inlet valve 215. The fluidizing agent engages with the media within media chamber 212, fluidizes it to become blasting mixture 298 and propels it through the outlet towards the target 299 via conduit 247 and hose 296. Once sufficient media resides in chamber B, the refill mode is stopped and the relief valve 241 is closed and the feeder valve 244 is set to the all closed position. Once the blast media 211 in chamber A is exhausted, chamber A switches to blast media refill mode where the media retainer 213 and inlet valve 246 are set to the closed position and the blast media refilling begins. While this happens, chamber B is transferred to blasting mode. This process repeats to provide continuous refilling of blast media and the flow of pressurized blast media towards the target.

Figure 20:
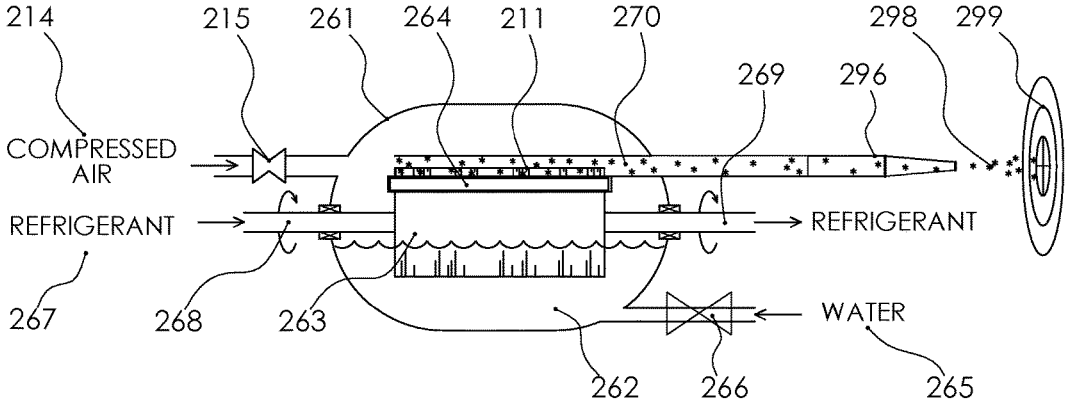
FIG. 20 is a schematic diagram illustrating an ice blasting system according to a further embodiment of the invention.

In the embodiment depicted in FIG. 20, a pressurized chamber 261 houses a water reservoir 262, rotating evaporator drum 263, and media collection system 264. The water reservoir 262 is filled to an appropriate level with water 265 via valve 266 and a fluidizing agent 214 is added under pressure to pressurize the chamber via the inlet valve 215. The evaporator drum 263 begins to rotate and a refrigerant 267 is fed through the evaporator drum 263 via conduit 268 to create a sheet of ice along the surface of the drum. The refrigerant 266 then leaves the evaporator drum via conduit 269 for further processing. A media collection system 264 is then used to collect the ice off of the drum and size it accordingly to create the blast media 211. The blast media 211 is then fluidized by the pressurized fluidizing agent 214 entering conduit 270 to create a blasting mixture 298 that is propelled through hose 296 towards the target 299.

Figure 21:
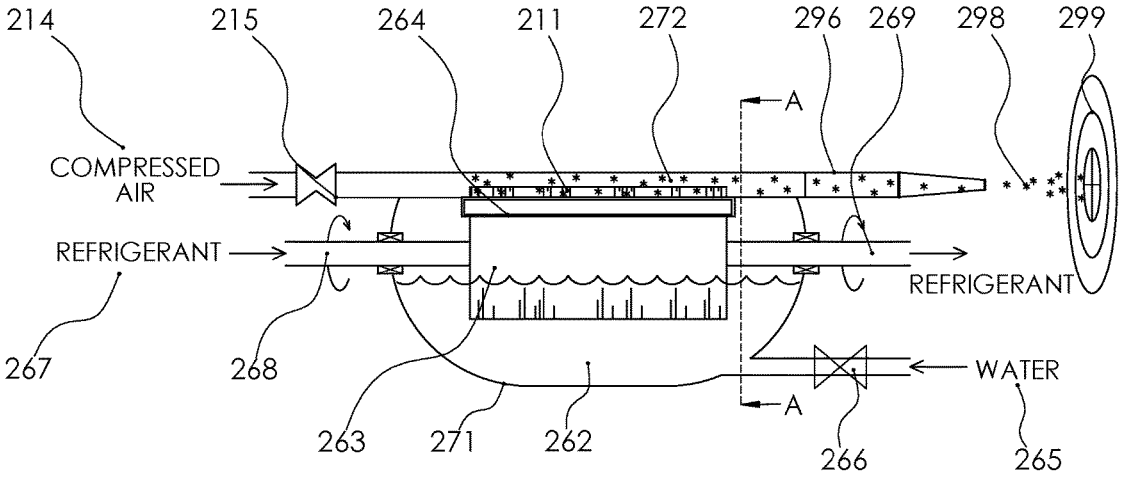
FIG. 21 is a schematic diagram illustrating an ice blasting system according to a further embodiment of the invention.
Figure 22:
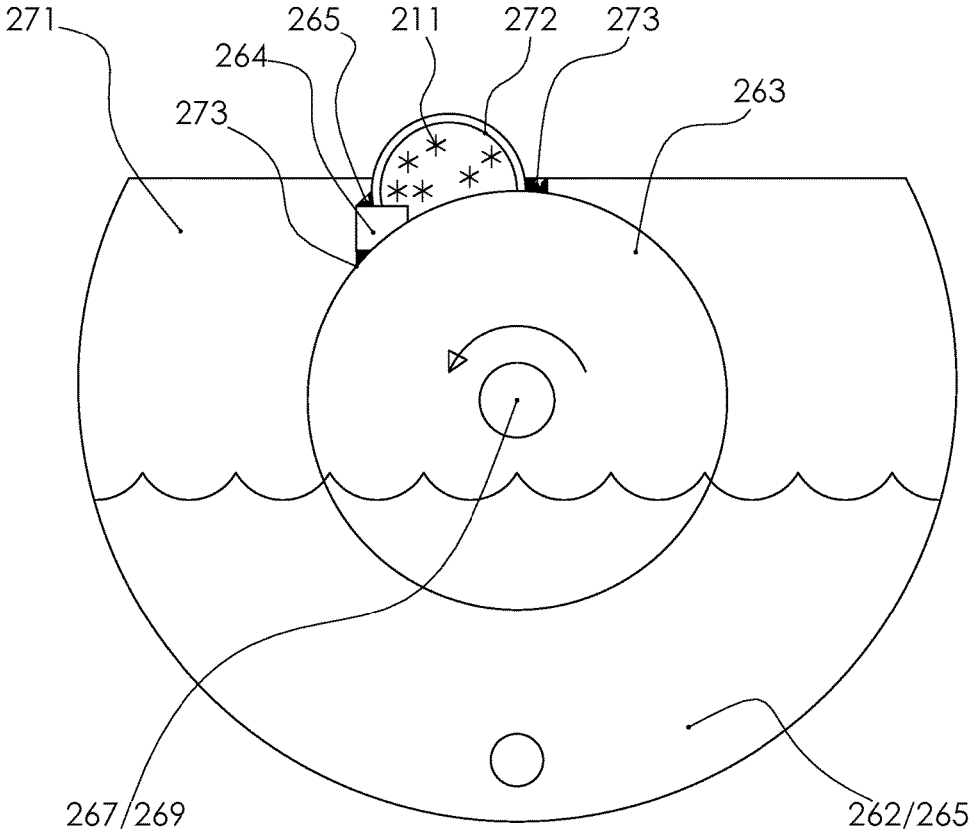
FIG. 22 is a cross-sectional view illustrating of the ice blasting system shown in FIG. 21 taken along lines A-A of FIG. 10.

In the embodiment depicted in FIG. 21 and FIG. 22, a chamber 271 houses a water reservoir 262, rotating evaporator drum 263, media collection system 264, and a high pressure conduit 272. The high pressure conduit 272 maintains a tight seal around the top portion of the evaporator drum 263 and the media collection system 264 with seals 273. The water reservoir 262 is filled to an appropriate level with water 265 via valve 266 and a fluidizing agent 214 is added under high pressure into the high pressure conduit 272 via the inlet valve 215. The evaporator drum 263 begins to rotate and a refrigerant 267 is fed through the evaporator drum 263 via conduit 268 to create a sheet of ice along the surface of the drum. The refrigerant 266 then leaves the evaporator drum via conduit 269 for further processing. A media collection system 264 is then used to collect the ice off of the drum and size it accordingly to create the blast media 211 within the high pressure conduit 272. The blast media 211 is then fluidized by the pressurized fluidizing agent 214 within the confines of the high pressure conduit 272 to create a blasting mixture 298 that is propelled through hose 296 toward the target 299.

Figure 23:
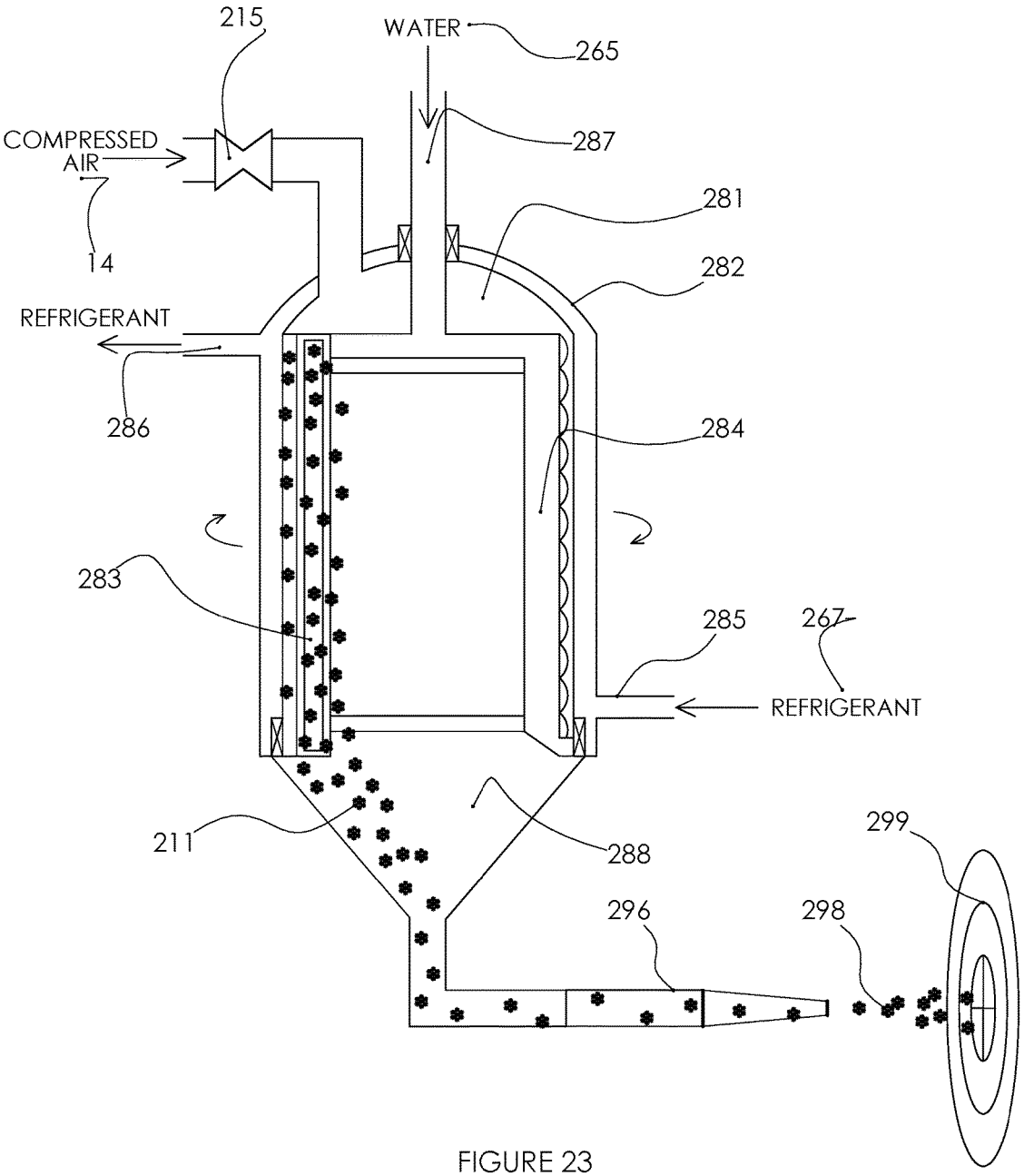
FIG. 23 is a schematic diagram illustrating an ice blasting system according to a further embodiment of the invention.
Figure 24:
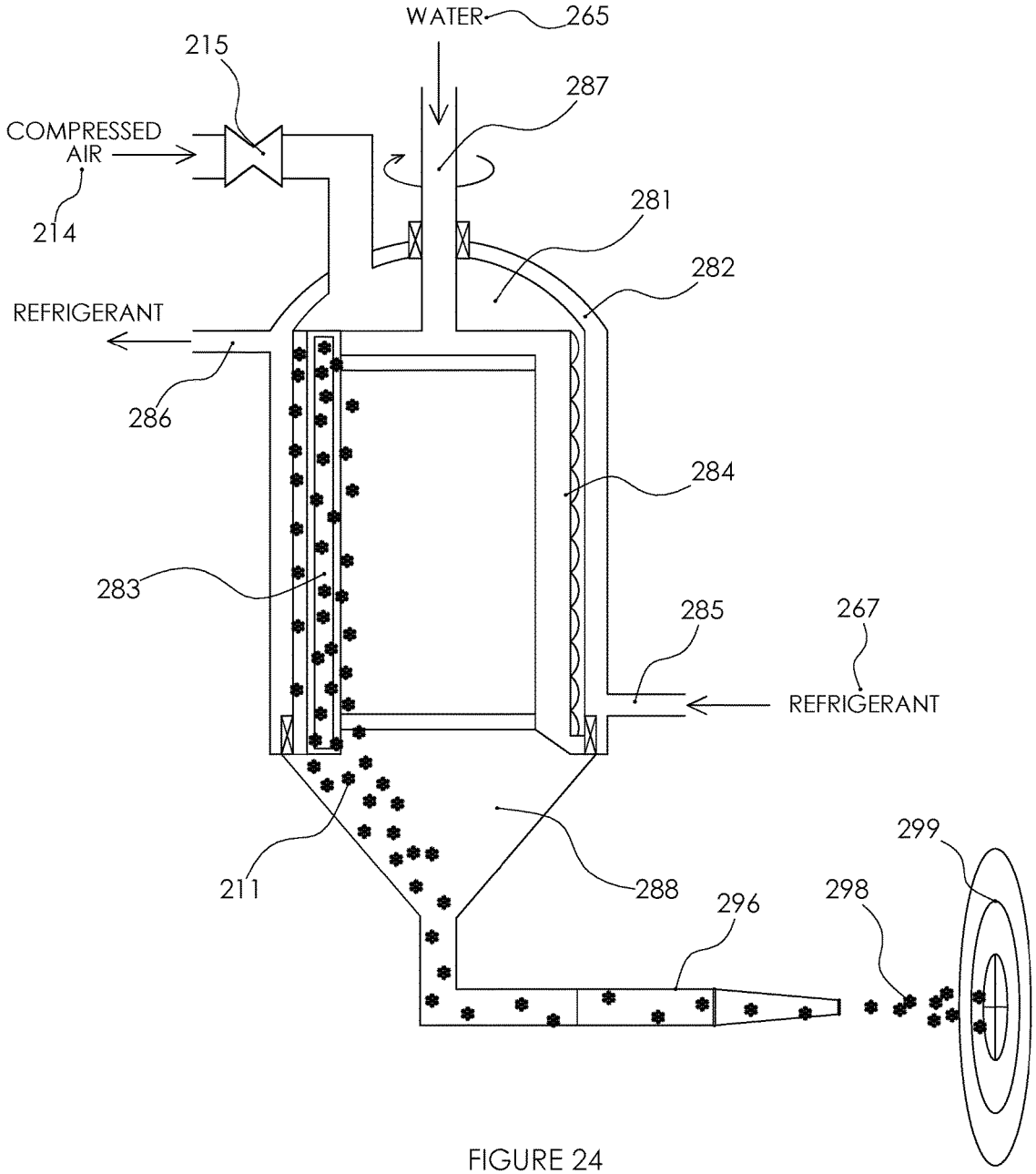
FIG. 24 is a schematic diagram illustrating the ice blasting system shown in FIG. 23 in which the evaporator drum is stationary and the ice collection system and deposit system are rotating.

In the embodiment depicted in FIG. 23, a pressurized chamber 281 houses an evaporator drum 282, a media collection system 283, and a deposit system 284. A fluidizing agent 214 is added under pressure to pressurize the chamber 281 via the inlet valve 215. The evaporator 282 begins to rotate and refrigerant 267 is fed through it via conduit 285 to cool the inside surface of chamber 281 and leaves the system via conduit 286. Water 265 enters the system via conduit 287 and is deposited along the inside wall of the chamber 281 to create a sheet of ice along the surface of the chamber 281 using deposit system 284. A media collection system 283 is then used to collect the ice off of the chamber walls and size it accordingly to create the blast media 211. The blast media is then fluidized by the pressurized fluidizing agent in hopper 288 to create the blasting mixture 298 which is propelled toward the target 299. FIG. 24 shows an alternative set-up where the evaporator drum 281 is stationary and the media collection system 283 and deposit system 284 are rotating about conduit 287.

Figure 25:
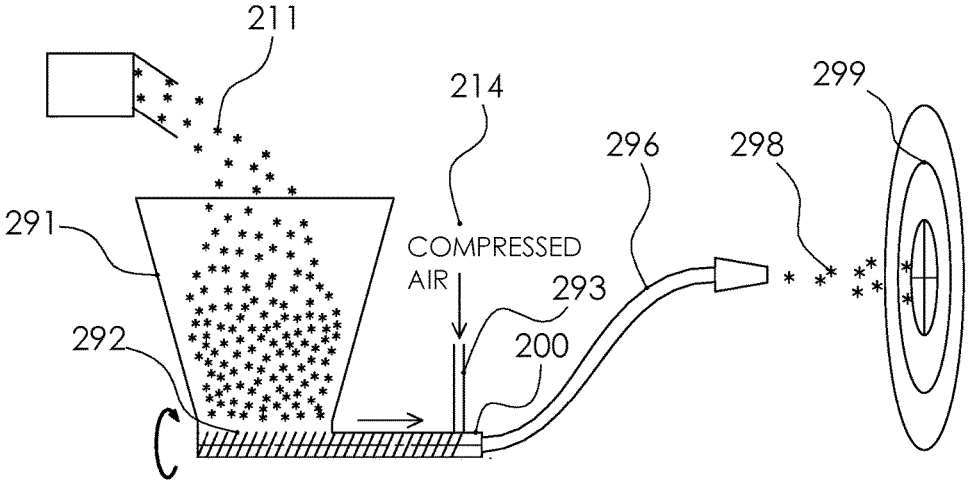
FIG. 25 is a schematic diagram illustrating an ice blasting system according to a further embodiment of the invention.

In the embodiment depicted in FIG. 25, the premade blast media 211 is deposited into the media hopper 291 where the media is collected by the auger 292 at the bottom of the hopper. Fluidizing agent 214 is fed through conduit 293 to the end of the auger 292. The blast media 211 is deposited into conduit 200 where it is mixed and fluidized to become blast media mixture 298. The blast media mixture 298 is then propelled towards the target 299 via hose 296 and outlet nozzle 297.

Figure 26:
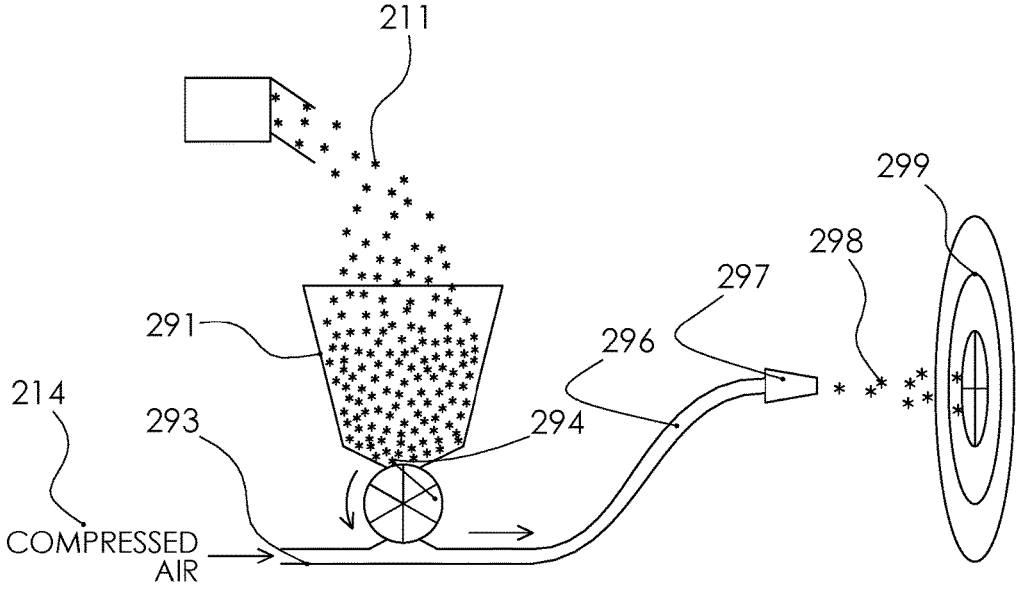
FIG. 26 is a schematic diagram illustrating an ice blasting system according to a further embodiment of the invention.

In the embodiment depicted in FIG. 26, the premade blast media 211 is deposited into the media hopper 291 where the media is deposited into a rotary airlock 294. Fluidizing agent 214 is fed through conduit 293 and the rotary airlock 294 cycles the blast media 211 into conduit 293 to produce blast media mixture 298. The blast media mixture 298 is then propelled towards the target 299 via hose 296 and outlet nozzle 297.

The disclosed device therefore provides a pressurized media blasting system with a single hose for use with blast media such as supplied water ice. Currently, a two hose system is used to deliver blast media to a target. The two hose system uses a Venturi nozzle to combine the high pressure fluidizing agent and the blast media before the blasting outlet. While a preferred form of refrigerant is liquid nitrogen, other cryogenic agents such as liquid helium, liquid neon, liquid argon or liquid krypton may be used, or other known refrigerants. The foregoing single hose systems are superior to the two hose system in regards to the increased outlet velocity of the blast media and the decreased weight and complexity of the blasting outlet. The single hose system is able to further increase the velocity of the blast media as it is mixed with the fluidizing agent prior to a converging-diverging nozzle, whereas the two hose system requires that the two streams combine after the converging-diverging nozzle to produce the Venturi effect. The increase in velocity of the blast media with the single hose system allows for more effective blasting due to the increase in kinetic energy.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A method of blast cleaning, comprising:

accepting water ice supplied in bulk form in any size ranging from 2 ml up to 10,000 ml from an external source into an input hopper via a hatch in a housing that houses the input hopper, wherein the hatch is accessible from above the housing;

sizing the water ice supplied in bulk form by a particle sizing module within the input hopper, wherein the sizing results in water ice particles of a smaller size;

mixing the water ice particles with a pressurized fluid in a mixing channel coupled to the particle sizing module to form a pressurized blast cleaning medium, wherein a pressure feeder module, the particle sizing module and the input hopper are all within the housing; and delivering the pressurized blast cleaning medium from the mixing channel through a single hose to a nozzle, wherein the water ice particles provide the primary blast cleaning component, wherein the nozzle receives the pressurized fluid only from the single hose.

2. The method of claim 1, wherein each of the water ice particles has a volume less than 2 ml.

3. The method of claim 1 wherein sizing the water ice comprises crushing the water ice using a V-shaped jaw formed of two sets of ice-crushing teeth.

4. A blast cleaning system, comprising:

a nozzle configured to deliver a pressurized blast cleaning medium, wherein the blast cleaning medium includes a pressurized fluid and water ice particles as the primary blast cleaning component;

an input hopper inside a housing and configured to accept supplied water ice in bulk form through a hatch in the housing accessible from above the housing from an outside source that is external to the blast cleaning system;

a particle sizing module within the hopper and configured to produce the water ice particles for the pressurized blast cleaning medium from the supplied water ice after the supplied water ice has been accepted into the input hopper;

a pressure feeder module configured to mix the water ice particles with the pressurized fluid to form the pressurized blast cleaning medium wherein the pressure feeder module moves the water ice particles from the particle sizing module at atmospheric pressure to a mixing channel that includes the pressurized fluid, wherein the pressure feeder module, particle sizing module and input hopper are all within the housing; and a single hose coupling the mixing channel to the nozzle, wherein the mixing channel includes an inlet configured to receive the pressurized fluid and an outlet configured to deliver the pressurized blast cleaning medium to the single hose, wherein the nozzle receives the pressurized fluid only from the single hose.

5. The blast cleaning system of claim 4, wherein individual water ice particles have a volume less than 2 ml.

6. The blast cleaning system of claim 4, wherein the supplied water ice includes portions of ice each having a volume greater than 2 ml and less than 10,000 ml.

7. The blast cleaning system of claim 4, wherein the particle sizing module crushes the supplied water ice to form the water ice particles, wherein the particle sizing module comprises a V-shaped jaw formed of two sets of ice-crushing teeth.

8. The blast cleaning system of claim 4, wherein the nozzle is a converging-diverging nozzle.

9. The blast cleaning system of claim 4, wherein the pressurized fluid is compressed air.

10. The blast cleaning system of claim 4, comprising wheels coupled to a bottom of the housing such that the blast cleaning system is portable.

11. The blast cleaning system of claim 4, wherein the pressure feeder module includes a rotor having multiple rotor pockets distributed along an outer surface thereof, wherein the rotor is configured to rotate continuously to move the water ice particles in the multiple rotor pockets from the particle sizing module to the mixing channel.

12. The blast cleaning system of claim 4, wherein the pressurized blast cleaning medium includes water vapor, liquid water, and water ice particles.

13. A water ice particle delivery device, comprising:

an input hopper disposed within a housing and configured to accept water ice supplied in bulk form via a hatch in the housing accessible from above the housing from an outside source external to the water ice particle delivery device, wherein the volume of each piece of water ice is greater than 2 ml and less than 10,000 ml;

a particle sizing module within the input hopper and configured to crush the water ice supplied in bulk form to create water ice particles;

a pressure feeder module configured to mix the water ice particles with a pressurized fluid to form a pressurized blast cleaning medium wherein the pressure feeder module moves the water ice particles from the particle sizing module at atmospheric pressure to a mixing channel that includes the pressurized fluid, wherein the pressure feeder module, particle sizing module and input hopper are all within the housing; and a single hose configured to deliver the created water ice particles to a nozzle wherein the nozzle receives the pressurized fluid only from the single hose.

14. The water ice particle delivery device of claim 13, wherein each of the water ice particles has a volume less than 2 ml.

15. The water ice particle delivery device of claim 13, wherein the pressurized fluid is compressed air.

16. The water ice particle delivery device of claim 13, wherein the particle sizing module includes a V-shaped jaw formed of two sets of movable crushing teeth assemblies.

17. The water ice particle delivery device of claim 16, wherein the movable crushing teeth assemblies are configured to operate in conjunction to crush and move the water ice.

* * * * *